US006228253B1

(12) United States Patent
Gandman

(10) Patent No.: US 6,228,253 B1
(45) **Date of Patent: *May 8, 2001**

(54) METHOD FOR REMOVING AND SUPPRESSING COKE FORMATION DURING PYROLYSIS

(76) Inventor: Zalman Gandman, 1770 E. 14th St., #4H, Brooklyn, NY (US) 11229

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/154,640

(22) Filed: Sep. 17, 1998

Related U.S. Application Data

(63) Continuation-in-part of application No. 09/027,943, filed on Feb. 23, 1998, now Pat. No. 5,944,961, and a continuation-in-part of application No. 08/870,070, filed on Jun. 5, 1997, now abandoned.

(51) Int. Cl.[7] ..... C10G 9/36; C10G 9/16

(52) U.S. Cl. ..... 208/48 AA; 208/130; 208/132; 585/648; 585/649; 585/650; 585/922; 585/950; 196/122; 196/126; 196/127

(58) Field of Search ..... 208/106, 132, 208/130, 48 AA; 585/648, 649, 650, 922, 950; 196/122, 126, 127

(56) References Cited

U.S. PATENT DOCUMENTS

| | | | | |
|---|---|---|---|---|
| 2,372,186 | | 3/1945 | Chaney | 196/47 |
| 2,893,941 | | 7/1959 | Kohfeldt et al. | 208/48 |
| 3,170,865 | | 2/1965 | Allen et al. | 208/48 |
| 3,522,093 | | 7/1970 | Woolman | 134/22 |
| 3,532,542 | | 10/1970 | Shimizu et al. | 134/20 |
| 3,617,478 | * | 11/1971 | King, Jr. et al. | 208/48 AA |
| 3,617,479 | | 11/1971 | King, Jr. et al. | 208/48 |
| 3,641,190 | | 2/1972 | Kivlen et al. | 260/683 |
| 3,704,333 | | 11/1972 | Spangler, Jr. et al. | 260/683 |
| 4,297,150 | | 10/1981 | Foster et al. | 148/6.3 |
| 4,410,418 | | 10/1983 | Kukes et al. | 208/48 |
| 4,454,021 | | 6/1984 | Watanabe et al. | 208/48 |
| 4,680,421 | | 7/1987 | Forester et al. | 585/648 |
| 4,692,234 | | 9/1987 | Porter et al. | 208/48 |
| 4,692,313 | | 9/1987 | Watanabe et al. | 422/241 |
| 4,708,787 | * | 11/1987 | Peters et al. | 208/130 |
| 4,889,614 | | 12/1989 | Forester | 208/48 |
| 5,208,069 | | 5/1993 | Clark et al. | 427/226 |
| 5,284,994 | * | 2/1994 | Brown et al. | 585/648 |
| 5,358,626 | | 10/1994 | Gandman et al. | 208/48 |
| 5,435,904 | | 7/1995 | Reed et al. | 208/48 |
| 5,446,229 | * | 8/1995 | Taylor et al. | 585/648 |
| 5,565,087 | | 10/1996 | Brown et al. | 208/48 |
| 5,567,305 | | 10/1996 | Jo | 208/48 |
| 5,944,961 | * | 8/1999 | Gandman | 202/241 |

FOREIGN PATENT DOCUMENTS

| | | |
|---|---|---|
| 687073 | 3/1967 | (BE) . |
| 1234205 | 2/1967 | (DE) . |
| 133570 | 1/1979 | (DE) . |
| 267674 | 5/1988 | (EP) . |
| 0617112 | 9/1994 | (EP) . |
| 1145288 | 10/1957 | (FR) . |
| 1497055 | 10/1966 | (FR) . |
| 2408644 | 6/1979 | (FR) . |
| 1578896 | 11/1980 | (GB) . |
| 55-71790 | 5/1980 | (JP) . |
| 191726 | 1/1967 | (RU) . |
| 2061018 | 12/1995 | (RU) . |
| 2061019 | 12/1995 | (RU) . |
| 9406889 | 3/1994 | (WO) . |
| 9811174 | 3/1998 | (WO) . |

OTHER PUBLICATIONS

Ascrizzi, Joseph M., "Ethane Specifications for Ethylene Production," *Hydrocarbon Processing*, Apr. 1967, vol. 46, No. 4, pp. 139–140.

* cited by examiner

*Primary Examiner*—Walter D. Griffin
(74) *Attorney, Agent, or Firm*—Robert W. J. Usher

(57) ABSTRACT

A method and apparatus for decoking and suppressing coke formation during pyrolysis has been discovered that does not require complete shut down of the pyrolysis furnace. For the decoking step, the hydrocarbon feed is cut off to one or more coils for usually less than about three hours during which a decoking additive is added to the steam flow in that coil. This additive is comprised of an aqueous solution of a group IA metal salt and a group IIA metal salt and catalyzes the coke removal. The hydrocarbon feed continues in the other coils during this procedure. After decoking, a suppression additive also comprising group IA and IIA metals is added to the steam and hydrocarbon feed. This suppression additive will melt onto the inner surfaces of the pyrolysis furnace coils, coating the coils with a glass layer which inhibits coke formation. The apparatus of the invention is particularly suited for introducing the additives of the invention into the steam flow at a desired drop size without touching the sides of the coil.

20 Claims, 9 Drawing Sheets

METHOD FOR REMOVING AND SUPPRESSING COKE FORMATION DURING PYROLYSIS

CROSS-REFERENCE TO RELATED APPLICATIONS

This is a continuation-in-part of application Ser. no. 08/870,070, filed Jun. 5, 1997, entitled REMOVAL OF COKE FROM PYROLYSIS FURNACE, now abandoned; this application is also a continuation-in-part of application Ser. No. 09/027,943, filed Feb. 23, 1998, now U.S. Pat. No. 5,944,961.

TECHNICAL FIELD OF THE INVENTION

The present invention relates to the field of thermal cracking (i.e. pyrolysis) of hydrocarbons for the production of olefins, particularly low molecular weight olefins such as ethylene. More particularly this invention is concerned with the removal and suppression of coke deposits which form on the walls of a pyrolysis furnace during such a thermal cracking process.

BACKGROUND OF THE INVENTION

In conventional pyrolysis processes which use pyrolysis furnaces, reaction mixtures of feed hydrocarbons and steam flow through a plurality of long coils or tubes which are heated by combustion gases to produce ethylene and other olefins, diolefins and aromatic hydrocarbons. The combustion gases are formed by burning hydrocarbon fuel such as natural gas or fuel oil. The combustion gases, which are external to the coils, are passed around the coils, countercurrent to the hydrocarbon feedstock which flows through the coils. Heat is transferred from the hot combustion gases through the walls of the coils to heat the hydrocarbon feedstock passing through the coils. Typically, the hydrocarbon feedstock is heated to about 750° C. to 950° C. However, in recent years, there has been a trend to heat the hydrocarbon feedstock to a higher temperature in order to obtain increased amounts of ethylene production for a given amount of feed. In other words, higher temperature is used to achieve greater selectivity for ethylene production.

The use of higher operating temperatures tends to promote or increase the production and collection of coke, already a known pyrolysis reaction by-product which collects on the inner walls of the coils. Coke is a semi-pure carbon which generally results from a combination of a homogeneous thermal reaction in the gas phase and a heterogeneous thermal reaction between the hydrocarbons in the gas phase and the metal walls of the coils.

Deposition of coke within the coils of a conventional pyrolysis furnace is associated with several deleterious effects. For example:

A. Coke formation on the inner walls of the coils impedes heat transfer to the reaction mixture in the coils or tubes. Thus, a smaller fraction of the heat of combustion is transferred to the hydrocarbon feed and a larger fraction of the combustion gas heat is thereby lost to the surroundings in the stack gas.

B. Due to the increased resistance to heat transfer, the temperature of the walls of the coils must be heated to even higher temperatures to adequately heat the hydrocarbon feed within the coils. This results in increased fuel consumption and damage to the coil walls and produces a shorter life for the expensive high-alloy coils. Typically this heat induced damage is caused by increased corrosion or erosion of the coil walls.

C. The coke build-up in the coils restricts the flow path in the coils and results in a larger pressure drop in the hydrocarbon-steam mixture flowing through the coils. Consequently, more energy is required to compress the hydrocarbon product stream in the downstream portion of the process.

D. The coke build-up in the coil also restricts the volume of reaction mixtures in the reaction zone, thereby decreasing the yield of ethylene and other valuable byproducts and increasing the yield of undesirable by-products (e.g. methane, tar, etc.). Thus the selectivity of the pyrolysis (the ability to produce the target compound for a given amount of feed) is decreased. Consequently, more hydrocarbon feedstock is needed to produce the required amount of the desired target compound.

Coke deposition is also a problem in heat exchangers or transfer line exchangers (often referred to as TLX's, TLE's, or quench coolers). Such coking is typically called "catalytic coking." The objective of a heat exchanger or TLX is to recover as much of the heat as possible from the hot product stream leaving the pyrolysis furnace. This product stream contains steam, unreacted hydrocarbons, the desired pyrolysis products and by-products. High pressure steam is produced as a valuable by-product in the TLX and the product mixture is cooled appreciably. As in the coil of the pyrolysis furnace, coke deposits in a heat exchanger, results in poorer heat transfer which in turn results in decreased production of high-pressure steam. Coke formation in a heat exchanger also results in a larger pressure drop for the product stream.

In addition to the above well recognized locations of coke deposit, coke might form on connecting conduits and other metal surfaces which are exposed to hydrocarbons at high temperatures. A more subtle effect of coke formation occurs when coke enters the furnace tube alloy in the form of a solid solution. The carbon then reacts with the chromium in the alloy and chromium carbide precipitates. This phenomenon, known as carburization, causes the alloy to lose its original oxidation resistance, thereby becoming susceptible to chemical attack. The mechanical properties of the tube are also adversely affected. Carburization may also occur with respect to iron and nickel in the alloys.

In pyrolysis devices currently used, coke formation and accumulation in the pyrolysis coils and/or in the heat exchangers or transfer line exchangers eventually becomes so great that cleaning is necessary. Known cleaning techniques typically require shutting down the pyrolysis unit (i.e. the hydrocarbon feed-stream flows are suspended) during the cleaning or decoking procedure. The flow of steam, however, is generally continued during the decoking or cleaning procedure because steam reacts slowly with the deposited coke to form carbon oxides and hydrogen. Moreover, air is often admixed with the steam. At the high temperatures in the coils, the coke reacts quite rapidly with the oxygen in the air to form carbon oxides. After some time, typically 1–3 days, the coke will generally be almost completely removed by this procedure. This cleaning is frequently referred to as "decoking."

Coke in heat exchangers is not as easily removed or gasified, however, due to the lower temperatures in heat exchangers as compared to the temperatures in the coils. Cleaning or decoking of heat exchangers is therefore often accomplished by mechanical means. Mechanical decoking may also be used for cleaning the coils.

One disadvantage associated with decoking with the steam-air mixture is an insufficient ability to control the combustion temperature in the coil during decoking. The temperature cannot be easily controlled due to the exothermic reactions involved when steam and oxidant react with the coke. Consequently, when a large amount of coke is deposited in the coils, local overheating may occur during decoking. Such overheating may heat the metal coil to a temperature which exceeds the temperature limit of the tube or coil metal. Generally, overheating leads to the development of splits, deformations, and other types of breakage of the tubes especially in the vicinity of the welding stitch.

In 1996, almost 50 billion pounds of ethylene were produced in the United States, primarily by the above-described process. It is anticipated that this production will increase to about 52 billion tons by 1999. In the Pacific Rim countries, about 10 billion pounds of ethylene were produced in 1996, primarily by the above-described process. It is anticipated that production will increase to about 40 billion tons by the year 2000.

For conventional pyrolysis units, decoking must be performed approximately every 30 to 60 days, depending on the hydrocarbon feed quality and the severity of the pyrolysis conditions. In the more modem pyrolysis furnaces such as the "Millisecond" sold by the Kellogg Chemical Company, decokings are performed every 10 days. As noted earlier, decoking generally requires about one to three days, resulting in downtime frequently causing a several percentage loss of ethylene production during the course of a year. Decoking is also relatively expensive and requires appreciable labor and energy. There is a strong incentive to extend the interval between decoking operations.

Numerous methods have been suggested for eliminating or minimizing coke deposition, in hopes of making long-term, continuous thermal cracking of hydrocarbons possible. For example, improved control of the operating conditions and improvement of feedstock quality has resulted in small decreases in the rate of coke deposition. The cost of making such changes, however, is often so high that these changes are frequently not cost effective.

Several processes have been reported in which various additives, asserted as being either inhibitors or catalysts, are added to the hydrocarbon-steam feedstream. If the additives are inhibitors, coke formation is inhibited or minimized. If the additives are catalysts, reactions between the coke and steam are presumably promoted or catalyzed. In such an instance, the formation of carbon oxides (CO and $CO_2$) and hydrogen are promoted. In either case, the net rate of coke which collects on the metal surfaces is decreased.

For example, sulphur has been proposed for use as an additive to reduce coke depositions in several patents. At least part of the beneficial effect of sulphur is generally considered to be caused by conversion of metal oxides on the inner surfaces of the coil walls to metal sulfides. The metal sulfides tend to destroy the catalytic effect of metal oxides which promote coke formation. Although sulphur may act as an inhibitor, it also frequently promotes the destruction of the coil metal walls by replacing the metal's corrosion resistant, protective oxide layer with metal sulfides which tend to flake off or be lost from the surface. Moreover, at high temperatures, some sulfides such as nickel sulphide, liquify. In addition, it is necessary to remove such inhibitors from the pyrolysis product to avoid contamination of the product by the inhibitors.

None of the approaches taught by the prior art which teach injection of antifoulant solutions to suppress the catalytically carbonizing action of nickel and iron in heat-resistant alloys has been entirely satisfactory. An added problem has been that apparatuses for injecting such solutions into the gaseous stream have not been effective in providing cover of the antifoulant over the entire inner surfaces of the coil or furnace tube.

As generally known, a solution may be dispersed into a process gas stream under several conditions. However, a disadvantage arises when the solution is injected as a continuous stream, because the solution may reside on a support surface as a statistical film, only one side of which contacts the process gas stream. Subsequent evaporation of the liquid, leaves solid residues (additives or solute) deposited on the support surface so that a substantial part of these additives are inactive. Furthermore, the deposition of the solution and subsequent evaporation may result in damage to the coil or furnace tube.

Most methods previously employed for removing coke deposits (i.e., with the steam-air mixture) require that the normal function of the furnace and the coils for cracking hydrocarbon materials be interrupted during the cleaning or coke removal operation. Such interruptions of on-stream time of the pyrolysis furnace produces serious economic problems in view of the unit off-stream operation which is required for the removal of coke deposits and the necessity to return the furnace to on-stream operation after decoking. As described above, normal decoking of the coils or furnace tubes often requires a feed outage of 1–3 days or even longer before decoking is complete. In addition, cycling the furnaces between the on-stream and off-stream mode of operation increases the wear of the tube supports.

Similarly, none of the prior art methods which use additives to remove coke deposits from the inner walls of the coils or tubes in a pyrolysis furnace have been entirely satisfactory. Accordingly, a process would be highly desirable if it could effectively decoke the coils or tubes within a pyrolysis furnace and suppress further coking without having to raise the temperature within the coils during the decoking process and without having to shut down the hydrocarbon feed of all of the coils or tubes within the furnace when decoking one or some of the coils or tubes.

SUMMARY OF THE INVENTION

In the method of this invention, a decoking additive comprising water soluble group IA and IIA metal salt is introduced into a pyrolysis furnace or other device from which coke is to be removed while maintaining the device within the temperature range which is effective for pyrolysis. This decoking additive has a high level of activity within the normal pyrolytic temperature range used during the pyrolysis procedure, enabling pyrolysis to be continued in at least some of the pyrolysis coils or tubes within the furnace while simultaneously decoking at least one of the tubes or coils.

That is, the combustion gases which are used to heat all of the tubes within the pyrolysis furnace provide adequate heat to accomplish decoking with the decoking additive of this invention without any specific temperature adjustments being required for the tubes in which decoking is taking place. Consequently, the tubes or coils in which pyrolysis is taking place are kept on-stream (i.e. hydrocarbon feed and steam continues to flow through these coils) while the coils or tubes which are simultaneously being decoked are taken off-stream during the decoking process (i.e. the hydrocarbon feed is cut off during decoking while the flow of steam is continued).

When the decoking procedure is complete in the tube or tubes undergoing decoking, these tubes may then be placed on-stream for pyrolysis while one or more of the coils or tubes which were previously on-stream are then taken off-stream for decoking. This procedure may be continued until all of the tubes or coils within the furnace have been decoked. It is not necessary to take all of the tubes off-stream simultaneously, and thus, the pyrolysis unit continues to produce the target product for a long period of time. This procedure avoids the higher decoking temperatures which are required when prior art decoking additives are used. Consequently there is less stress placed upon the coils so that they have a longer useful life.

Although a group IA metal salt may be used in combination with a group IIA metal salt, it is preferable to avoid the use of sodium salts in the decoking additive solution. In a preferred embodiment, the decoking additive comprises lithium or potassium salts of carbonate, nitrate, acetate or mixtures thereof, or calcium, magnesium, or barium salts of an alkanoic acid, preferably calcium, magnesium, or barium acetate, nitrate, or mixtures thereof.

The decoking additive may be added in any convenient form but is preferably dispersed or dissolved in a solvent, and is most preferably in the form of an aqueous solution. Concentrations of less than about 1 gram of the additive mixture per liter of solvent (or about 0.1 wt. % additives in the solution) are preferred.

It has also been discovered that additional advantages may be obtained by adding a suppression additive of this invention to the steam or to the hydrocarbon feedstock to form a coating on the internal surfaces of the pyrolysis coils. The suppression additive is preferably comprised of potassium salts of silicon acid such as potassium tetrasilicate ($K_2Si_4O_{10}.H_2O$), potassium tetraborate, ($K_2B_4O_7.H_2O$), potassium liquid glass, potassium pentaborate ($K_2B_{10}O_{16}.8H_2O$), potassium hexametaphosphate [$(KPO_3)_6$], lithium borate, lithium nitrate ($LiNO_3$), potassium nitrate ($KNO_3$), magnesium nitrate [$Mg(NO_3)_2$], calcium nitrate [$Ca(No_3)_2$], or barium nitrate [$Ba(NO_3)_2$], or boric acid ($H_3BO_3$). These additives form the following coatings:

(a) Alkali—silicon coating;

(b) Alkali—boron coating;

(c) Barium—boron coating;

(d) Nitrate—glass coating;

(e) Alkali—phosphorus coating.

All of the above described coatings are glass or enamel which form on the hot metallic surface of the furnace tubes. They adhere strongly to the hot metallic surface of the furnace tubes or coils and can last a long time. These glasses are very stable and simple (i.e., relatively easy) to apply.

The suppression additives described above are dissolved, preferably in water, before insertion or injection into the steam or hydrocarbon feedstock. The concentration of these additives in solution is preferably about 0.5–1.0 gram per liter. The temperature of the coils or feedstock should be sufficient to melt the additives so the coating may form; usually the temperature for pyrolysis will be adequate and no temperature adjustments will be needed.

This coating inhibits and suppresses the deposition of coke on the inner walls of tubular furnaces such as pyrolysis coils or other devices in which coke deposits are a problem, thus extending the time interval between decoking operations.

The suppression additive of this invention is preferably used to form the coating as a pretreatment step before an excessive amount of coke is deposited within the device. In particular, this pretreatment operation is advantageously performed immediately after the decoking cycle as a pretreatment of the pyrolysis coils or tubes or other devices to suppress new coke formation or deposition. Preferably, 1–500 ppm of suppression additive is used in the hydrocarbon feedstock to produce the desired coating.

In the conventional pyrolysis of hydrocarbon feedstock in tubular furnaces, the hydrocarbon feedstock is heated to produce the reaction products. The reaction products are then separated and recovered at the outlet of the tubular furnaces. The formation of coke in the tubular furnaces or pyrolysis coils hinders heat exchange between the combustion gases and the hydrocarbon feedstock flowing within the coils. Therefore, in order to maintain the feedstock at the required temperature, it usually becomes necessary to increase the temperature of the combustion gas to compensate for the diminished heat exchange capability of the tubes which have a deposit of coke thereon. This produces a variation of the tube wall temperature during the course of pyrolysis. In addition, partial occlusion of the tubes or coils makes it necessary to increase the pressure of the hydrocarbon feedstock at the inlet of the furnaces to ensure adequate flow during the pyrolysis procedure. As the amount of deposited coke increases within the tubes, there is a commensurate increase in the tube wall temperature and a commensurate increase in the pressure of the hydrocarbon feedstock at the inlet of the furnace. When the temperature and pressure exceed a permissible limit, it becomes necessary to decoke the tubes so that the tube wall temperature and pressure can be restored to the permissible limits which are well known to those skilled in the art.

Thus, the feeding of steam and decoking additive in accordance with this invention are advantageously performed until a sufficient amount of coke is removed so that the above described temperature and pressure are returned to the normal or permissible range for conventional pyrolysis furnaces. In view of the above, it is desirable to monitor the temperature and pressure during pyrolysis so that one can determine when to initiate the decoking procedure. Likewise, the temperature and pressure are desirably monitored during the decoking procedure so that it can be stopped once the temperature and pressure return to the normal range. Upon termination of the decoking procedure when the normal temperature and pressure values are reached, the hydrocarbon feedstock is once again initiated for continuing normal pyrolysis. As noted above, at this point it is desirable to pretreat the pyrolysis coils with the suppression additive in accordance with this invention to form the desired coating of the coils which will extend the time interval required before it becomes necessary to once again decoke the device.

This invention further provides an apparatus for injecting the additives of the invention or any liquid solution into the hot gaseous process stream in a thermal cracking furnace tube. This apparatus allows the additives to more effectively inhibit the formation and deposition of coke, and to remove coke deposits, by causing injection of the liquid solution so that it does not contact the furnace tube/coil.

The apparatus of the invention comprises the combination of a centrifugal nozzle which atomizes a pressurized stream of liquid solution to form small drops and a mixing and vaporizing chamber into which the drops are discharged by the nozzle. The mixing and vaporizing chamber is defined by an apertured tubular flow deflector extending across the furnace tube or coil so that the deflected gas stream passes through the apertures into the chamber dispersing and vaporizing the drops entirely within the chamber without contact of the solution with either the chamber or the surrounding furnace tube, thereby obviating a risk of furnace tube collapse by contact with an evaporating liquid solution. Thus, only dispersed particulate material is entrained in the hot gaseous process stream in the thermal cracking furnace tube gas stream for distribution throughout the remainder of the furnace tubes.

One embodiment of the apparatus of the invention comprises:

(a) an inner liquid supply tube having one end for connection to a pressurized supply of a liquid solution and another end extending through an access port along the furnace tube;

(b) a centrifugal, atomizing nozzle having an inlet mounted to another end of the supply tube, and a nozzle outlet for discharging the liquid solution as a spray of small drops;

(c) an outer tube extending in concentric, insulating relation along the liquid solution supply tube between the access port and the nozzle;

(d) a flow deflector comprising an apertured peripheral wall having a portion defining a tubular mixing and vaporizing chamber extending coaxially along the furnace tube and having an axial inlet end mounted in registration with the nozzle outlet to receive all spray therefrom and an axial outlet end which is radially enlarged so as to deflect the gaseous process stream through wall apertures into the chamber thereby dispersing and vaporizing all drops of liquid solution within the chamber without the liquid solution contacting the peripheral wall and the furnace tube so that only particulate material is entrained in the gas process stream leaving the outlet end for dispersal downstream throughout a radiation stage of the furnace.

DETAILED DESCRIPTION OF INVENTION

Figure 1A:
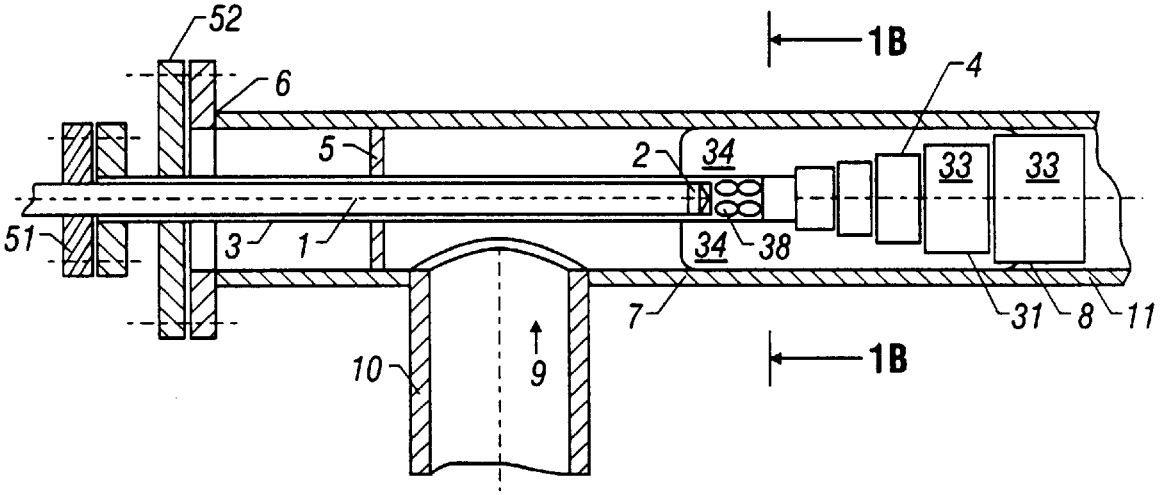
FIG. 1*a* is a diagrammatic view of a first embodiment of an injection apparatus according to the invention.

The present invention provides an improved process for thermal cracking of hydrocarbon feedstocks in the presence of steam wherein coke deposits which are produced during the thermal cracking are removed without having to shut down the entire cracking or pyrolysis furnace. Instead of shutting down the entire furnace, only one or a few of the coils contained in the furnace are shut down (i.e. taken off-stream) while the remaining coils may remain on-stream so that pyrolysis can occur simultaneously with the decoking operation in one or a few of the coils.

It has now been found that coke deposits can be effectively removed from cracking furnace tubes by introducing steam (preferably without air) and decoking additives at the inlet to the radiant coil of the cracking furnace while simultaneously reducing or eliminating normal hydrocarbon feed to this coil. The remaining coils of the cracking furnace can remain in normal service so that pyrolysis can proceed in an uninterrupted manner.

The decoking additives of this invention comprise water soluble group IA and IIA metal salts. Preferably, the decoking additive comprises lithium or potassium salts of carbonate, nitrate, acetate or mixtures thereof, or calcium, magnesium, or barium salts of an alkanoic acid, preferably calcium, magnesium, or barium acetate, nitrate or mixtures thereof. These salts are readily available, inexpensive and easily dissolved in polar solvents, such as water. Sodium salts are preferably avoided.

The decoking additive of this invention acts as a catalyst to remove the coke from the coils.

After decoking, a coke suppression additive of this invention may be added to the steam and to the hydrocarbon feedstock. This additive is believed to increase the time between decoking about six or more times the frequency needed with prior art methods.

The coke suppression additive of this invention preferably comprises potassium salts of silicon acid, potassium liquid glass, potassium tetraborate, potassium pentaborate, potassium hexametaphosphate, lithium borate, lithium, potassium, magnesium, calcium, barium nitrates, or boric acid. These suppression additives may, or are believed to, provide a glass or enamel coating on the walls of the pyrolysis furnace tube or coil and to thereby suppress coke deposition on the metallic-alloy internal surfaces of the tube or coil.

Such coating may also be applied to a new coil that has not been and does not need to be decoked provided that the conditions are such that the coating may form. In such cases, pyrolysis conditions, including temperature, are preferred.

Specific examples of typical alloys comprising furnace tubes which may be subjected to such protective treatment with the coke suppression additives of this invention include high alloy steels such as Anchylose®, ANSI/AIK40 and ANSI/HP-50 grade materials and the like which are typically used in the construction of furnace tubes and other structures employed in areas of a pyrolysis device.

Preferably, the apparatus of this invention will be used for introducing the decoking and coke suppression additives into the system. Best results with the additives are obtained when the drop size of the additive solution is about 0.5–3 microns and the additives are introduced into the steam flow in the coil without touching the sides of the coil. The apparatus of this invention can accomplish such introduction of the additives into the coils without touching the sides of the coil and at the desired drop size.

A more complete appreciation of the invention and many of the intended advantages thereof will be readily apparent by reference to the following detailed description when considered in connection with the accompanying drawings.

Figure 9:
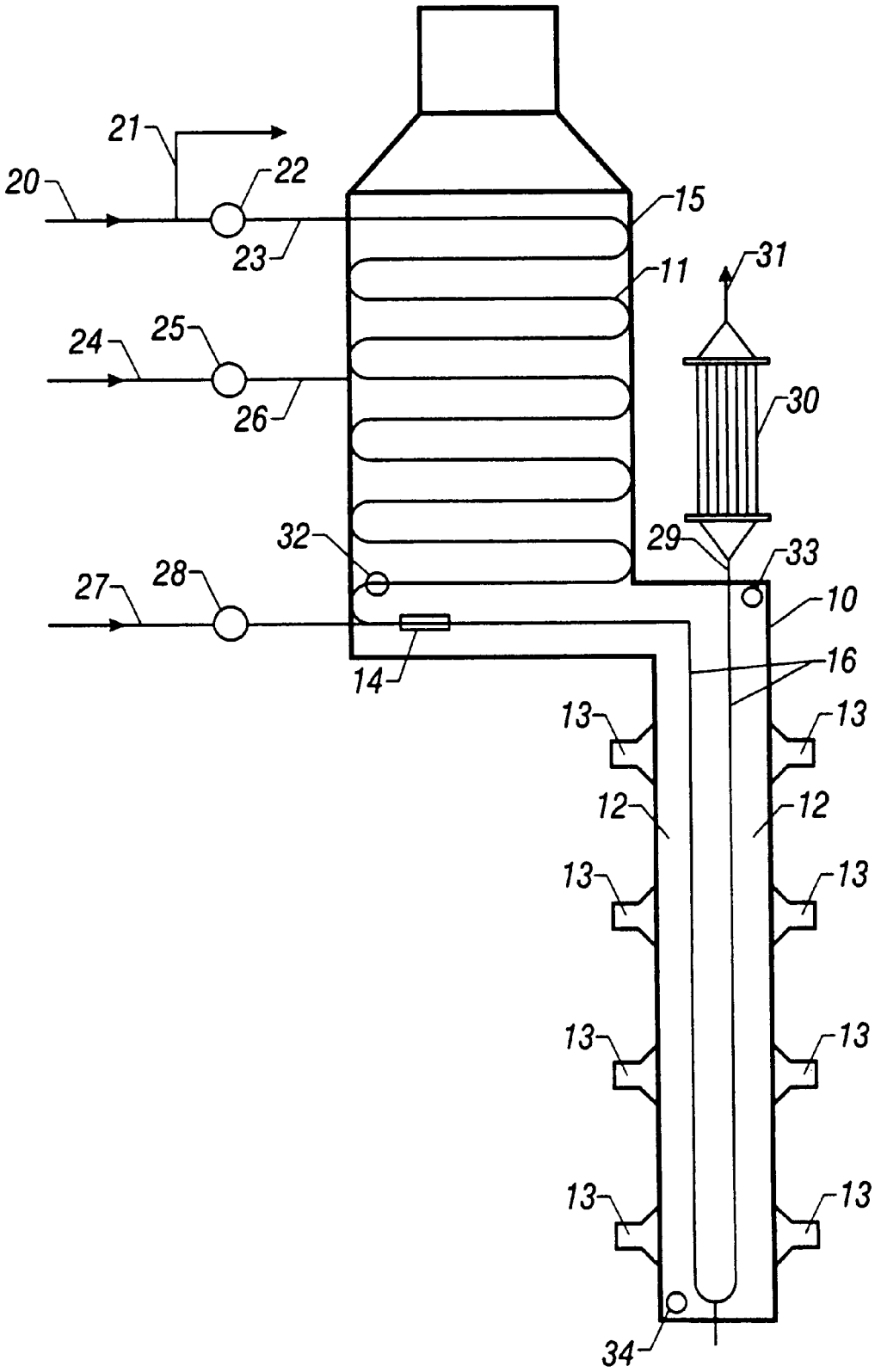
FIG. 9 is a flow diagram for a pyrolysis unit of the type which is used to produce low molecular weight olefins such as ethylene and propylene.

FIG. 9 depicts a flow diagram for a conventional pyrolysis unit 10. The pyrolysis unit 10 comprises an upper convection section 11 and a lower radiant section or cracking zone 12. A plurality of burners 13 are provided on the sidewalls and/or on the bottom of the furnace to supply heat. The burners can be adjusted to raise or lower the temperature within the pyrolysis unit. Typically such furnaces contain a plurality of coils (passes) or tubes in parallel. However, for the sake of simplicity and clarity, only one such coil is shown, it being understood that the device typically contains a plurality of such coils which are identical to the one shown. Typically each coil comprises a plurality of connected tubes which provide a flow path through the unit. In FIG. 9, one pass is shown with the tubes in the convection section 11 designated by numeral 15 and the cracking coil in the cracking or radiant zone 12 designated by numeral 16.

In order to keep some of the coils on-stream while other coils are taken off-stream during the decoking process, a separate control is provided for the supply of hydrocarbon feedstock to each of the coils contained in the pyrolysis unit. FIG. 9 shows a supply conduit 20 which is used to supply hydrocarbon feedstock to manifold 21. Manifold 21 is used to distribute the hydrocarbon feedstock to the plurality of coils. FIG. 9 shows the manifold distributing the hydrocarbon feedstock to one of the coils. More particularly, FIG. 9 shows a valve 42 which can be used to regulate the flow of feedstock from manifold 49 to conduit 43 which leads to one of the coils. A similar valving arrangement may be provided for each of the coils so that the hydrocarbon stream distributed by the manifold can be opened or closed for each coil. Closing a valve such as valve 42 will take the coil which is controlled by the valve off-stream. Likewise, opening the valve will restore the coil to on-stream operation.

Steam which is used in the decoking operation as well as in the pyrolysis operation is supplied through inlet line 44 and valve 25 to the conduit 26 which is connected to the coils. This arrangement may be used for each coil so that the amount of steam entering each coil can be separately regulated.

An inlet conduit 27 is provided for the injection of the additive solutions of this invention into each coil. A valve 28 may be provided for each conduit 27 so that the addition of the additive solutions can be separately regulated for each coil. As shown in FIG. 9, the additives are injected downstream from the point of steam injection so that the additives are added after the steam has been heated in convection zone 11. FIG. 9 illustrates a preferred embodiment wherein the additives are injected into the convection coil through nozzle 14 of this invention just before the convection coil enters the radiation stage or cracking zone 12.

The reaction products are discharged from the coils (one of which is shown by reference numeral 46) of the cracking furnace via conduit 29 into the TLX shown by reference numeral 30. The cooled reaction products are discharged via conduit 48. The discharged products can then proceed to a conventional fractionator, dryer and the like.

The on-stream decoking procedure requires opening the additives valve 28 and closing off part or all of the hydrocarbon feed valves 42. Preferably, in order to obtain the full advantages of this invention, some of the hydrocarbon feed valves are left open so that a portion of the coils remain on-stream while the remaining portion of the coils undergoing decoking, are kept off-stream during the decoking procedure. The amount of steam and additive solution passed through the decoking conduits 44 and valve 25 is adjusted so that the steam temperature inside the pass is preferably about 500° C. or higher at the point of transition from the convection tubes 45 to the radiant tubes 46. The temperature of the material inside the tubes can also be regulated by adjusting the amount of combustion which occurs at burners 13 to raise or lower the temperature and amount of combustion gases passing through unit 10. When sufficient time has elapsed to allow the coke to be removed from the inside of the tubes, valve 26 is closed and valve 42 is opened thereby restoring the coil which has undergone decoking to the on-stream status.

The progression of coke removal is indicated by (1) the decrease in the pressure drop; (2) a decrease in the tube metal temperature; (3) a decrease in the content of carbon dioxide ($CO_2$) in the combustion gases.

Preferably the temperature of the steam entering the radiant section of the furnace to be decoked is about 500° C. or higher.

The decoking additive of this invention is preferably dissolved in water prior to injection into the steam feed stream in the coils.

The concentration of decoking additive in solution is preferably less than about 1 gram of the additive mixture per liter of solvent or about 0.1 wt. % of the additive mixture in the solution.

According to a preferred embodiment of the method of the invention, the decoking additive solution is preferably introduced into the steam stream at the point of transition from convection tubes 45 to radiant tubes 46. This technique was found to be effective in introducing uniform amounts of additives to each radiant coil in the radiation section 12 of the furnace. The reaction mixture (steam and additives) in the tubes during the decoking procedure is preferably kept at a temperature which ranges from about 800° C. to about 950° C.

The mass rate of steam entering the coil of the furnace to be decoked should preferably be greater than 35 kilograms per square meter of tube internal cross-sectional area. Higher mass rates than 35 $kgs/m^2 \cdot second$ at constant temperature reduce the time required for decoking. Higher operation pressure in the furnace tubes being decoked requires more decoking time.

With reasonable optimum steam mass rates and temperatures, a furnace pass or coil may be decoked in 2–3 hours or less. After decoking a fraction of the coils has been completed, the same procedure may be used at any time deemed desirable to decoke additional coils. As noted above, if so desired, two or more coils (passes) in a multi-pass furnace can be decoked in this manner simultaneously.

The velocities of the carbon steam conversion reactions/ are dependent on temperature, pressure and activity of the catalysts (decoking additives). The velocity of the carbon steam conversion reactions are presented in Table 1.

TABLE 1

| SALT | TEMPERATURE ° C. 700° C. | 800° C. | 900° C. |
|---|---|---|---|
| Blank | — | 0.0014* | 0.011* |
| $Li_2CO_3$ | 0.041 | 0.470 | 1.00 |
| $KNO_3$ | 0.010 | 0.090 | 0.65 |
| $K_2CO_3$ | 0.007 | 0.070 | 0.55 |
| KCE | 0.0013 | 0.022 | 0.23 |
| $K_3PO_4$ | 0.0004 | 0.007 | 0.07 |
| $K_2SiO_3$ | — | 0.002 | 0.015 |
| $MgAc_2$ | 0.005 | 0.044f | 0.250 |
| $CaAc_2$ | 0.004 | 0.037 | 0.220 |

*milligrams per hour of coke gasification of reactions 1–4 shown below
Reaction (1): $C+H_20 \rightarrow CO+H_2-28.38$ kcal/Kmol
Reaction (2): $C+2H_20 \rightarrow CO_2+2H_2-17.97$ kcal/Kmol
Reaction (3): $CO_2+C \rightarrow 2CO-38.79$ kcal/Kmol
Reaction (4): $CO+H_20 \rightarrow CO_2+H_2+9.8$ kcal/Kmol As shown in Table 1, the reaction velocities obtained through the use of the decoking additives is more than 50 times higher than the result achieved when decoking was conducted in the presence of steam without any additives. The salts of the group IA metals have higher activity as evidenced by the higher velocity than the group IIA salts (about 2–3 times).

The relative activity in the steam conversion reactions described above with respect to the salts of the group IA and group IIA metals have the following order: Li>K>Na>Mg>Ca>Ba.

Decoking reaction numbers 1, 2, and 3 are endothermic and run with increasing volume. This means that the degree of coke conversion is increased at higher temperatures and at lower pressures. Unlike prior art decoking methods, no air is used and the endothermic nature of the decoking reactions does not result in local temperature rise or overheating commonly a problem with traditional decoking methods employing air mixed with steam.

In the presence of a hydrocarbon feed, reactions (1), (2), (3), and (4) above are retarded and the coking process is more prevalent than the decoking process. In this situation, increasing the amount of decoking additives is not effective, and one must eliminate the hydrocarbon feed during the decoking process in the specific coil undergoing decoking.

According to one embodiment of the method of the present invention, the decoking additive should preferably comprise two or more active salts. In particular, the decoking additive should preferably comprise two or more of lithium salt, potassium salt, calcium salt, magnesium salt, and barium salt. Most preferably, such salts included in the decoking additive would be lithium or potassium salts of carbonate, nitrate, acetate or mixtures thereof, and calcium, magnesium, and barium acetate, nitrate or mixtures thereof.

The amount of decoking additive of the invention introduced into the coils of the cracking furnace is preferably regulated so that it remains in a range of from about 5.0 to 500 parts of group IA and IIA metal per million parts of steam feed, depending upon the differential pressure (pressure drop) in the pyrolysis coils.

In a preferred embodiment of the present invention, the elemental weight ratio of the lithium or potassium salts to the calcium, magnesium, and barium salts in the decoking additive ranges from about 0 to about 5.0. An especially preferred elemental weight ratio of the lithium or potassium to the calcium, magnesium, and barium in the decoking mixture ranges from about 0.001 to about 2.5. The concentration of the decoking additive in solution is about 0.5 to 1 grams per liter.

Without limiting this invention, it is believed that the decoking procedure of the present invention results in a breakage of the bond between the carbon of the coke and the coils. The breakage of this bond results in spalling of the coke deposits. As a result of this spalling, coke deposits can be removed in bulk from the coils as a powdered or granular mass by the steam. A small amount of the decoking additives of the invention added to the steam promote the spalling of the coke, which is blown out with the steam as a granular or as a powdery mass. This spalling phenomenon results in the rapid removal of coke from the coil without having to depend upon total gasification of the coke in order to remove it from the coil.

Further without limiting the invention, it is believed that the decoking additive solution generates carbon dioxide gas within the interstices of the coke deposit and this gas also promotes spalling to thereby result in the ejection of coke deposits from the coils during the decoking procedure. Furthermore, expansion of the generated gas also contributes to the spalling phenomenon.

Typically after about two or three hours of injection of the decoking additive of this invention into the steam flow in the coils, a pressure drop within the coils shows that the coke is being removed. At or after this point (of pressure drop) in the preferred embodiment of the invention, addition of decoking additive may be stopped and the hydrocarbon feed may be resumed.

The method of the present invention may also be used for decoking and cleaning other types of heaters or the like, such as furfural refining heaters, naphtha and tar heating coils.

After decoking, further advantages of the invention may be obtained by adding the coke suppression additive of this invention to the hydrocarbon stream. In the stream, this additive will act to suppress new coke formation or deposit on the coils of the pyrolysis furnace.

To obtain adherent and uniform suppression coatings or films, the alloy surface should be decoked prior to thermal decomposition of the coke suppression additives in contact therewith.

When the decoking procedure is complete in the coil (or coils) undergoing decoking, in the preferred embodiment of this invention, the coke suppression additive of this invention is introduced into the steam flow of the off-hydrocarbon stream coil(s). After about one hour of introducing and injecting coke suppression additive into the steam flow, the coil is brought on-stream again and the coke suppression additive is continuously introduced into the hydrocarbon flow of the now on-stream coil for about two hours. The amount of the coke suppression additive which is introduced into the steam and hydrocarbon feeds is about 50 to 700.0 parts of group IA and IIA metal per million parts of steam and hydrocarbon feeds, depending on the desired suppression film thickness.

The concentration of the coke suppression additive in the solution is about 0.5 to 1 gram per liter.

Preferably the temperature of the steam or hydrocarbon feed entering the radiant tubes/coils of the cracking furnace for introducing the coke suppression additives which form suppression films or coatings on the tube walls should be about 350° C. or higher.

The mass rate of steam flow entering the off-steam coils for introducing the coke suppression additive and forming or applying the suppression films should preferably be about 15 to about 30 kilograms per square meter of the tube internal cross-sectional area.

The steam that flows through the tubes while the coke suppression additive is injected and the coating being applied is preferably kept at temperatures ranging from about 850° to about 1000° C.

When the alloy surface of the coils is contacted with the coke suppression additive, the additive converts to glass or enamels at these temperatures from about 850° C. to about 1000° C. and forms a coating thereon.

Table 2 represents the coke suppression additive as used according to the present invention.

TABLE 2

The coke suppression additive, (milligrams per liter of solution)

| | SYSTEMS OF COATING | | | | |
|---|---|---|---|---|---|
| Ingredient | Alkali-Silicon | Alkali-Boron | Barium-Boron | Nitrate-Glass | Alkali-Phosphorus |
| $K_2Si_4O_{10}.H_2O$ | 1000.0 | — | — | — | — |
| $K_2B_4O_7.H_2O$ | — | 1000.0 | — | — | — |
| $(KPO_3)_6$ | — | — | — | — | 1000.0 |
| $K_2B_{10}O_{16}.8H_2O$ | — | 1000.0 | — | — | — |
| $H_3BO_3$ | — | 100–200 | — | — | — |
| $K_2B_4O_7.H_2O$ | — | 900–800 | — | — | — |
| $KNO_3$ | — | — | — | 240–610 | — |
| $Mg(NO_3)_2$ | — | — | — | 760–390 | — |
| $LiNO_3$ | — | — | — | 360–520 | — |
| $Mg(NO_3)_2$ | — | — | — | 640–480 | — |
| $KNO_3$ | — | — | — | 400–700 | — |
| $Ca(NO_3)_2$ | — | — | — | 600–300 | — |
| $Ba(NO_3)_2$ | — | — | 50–100 | — | — |
| $H_3BO_3$ | — | — | 950–900 | — | — |

All of the compounds shown in Table 2 form the liquid glass of the systems ($K_2O$—$SiO_2$), ($K_2O$—$B_2O_3$); [$LiNO_3$—$Mg(NO_3)_2$], [$Ca(NO_3)_2$—$KNO_3$], [$Mg(NO_3)_2$—$KNO_3$], and ($K_2O$—$P_2O_5$), respectively. Such liquid glass adheres or sticks to the alloy surface of the furnace tubes, and gradually settles there as a coke suppression film or coating. Such suppression films coating the inner walls of the alloy tubes have about 10 microns of thickness and can suppress coke deposits about 60–90 days. The coatings adhere best to a heated alloy surface. The conversions of the additive to the film is preferably carried out at temperatures from about 850° to 1000° C. Temperatures sufficiently high to melt the coke suppression additive are necessary for the film or coating to form.

For example, the alkali-silicon coating is comprised of $K_2O$—$SiO_2$ glass. Potassium tetrasilicate ($K_2Si_4O_{10}.H_2O$) has a melting point of about 767° C., and when it comes in contact with the hot metallic surface of the furnace tubes or coils, the metal temperature being about 950–1050° C., this salt melts. The melted potassium tetrasilicate covers the inner wall of the furnace tubes or coils while it passes in and with the potassium tetrasilicate mixture in the steam or steam-hydrocarbon flow. This melted salt settles somewhat piecemeal because the potassium ion, $K^+$, is volatile. When the content of $SiO_2$ in potassium tetrasilicate increases from about 71.8 wt. % to about 80 wt. % (due to the volatilization of the potassium ion,) the melting point of the coating increases to about 1080° C. and this coating becomes solidified.

Potassium liquid glass also forms the coating of glass of system $K_2O$—$SiO_2$. When potassium liquid glass comprises about 45 wt. % $SiO_2$, 67 wt. % $SiO_2$ and 74 wt. % $SiO_2$, the melting point of these glasses are the following:

45 wt. % $SiO_2$—780° C. (mixture of potassium meta and disilicate);

67 wt. % $SiO_2$—742° C. (mixture of potassium di and tetra silicate); and 74 wt. % $SiO_2$—767° C. (potassium tetra silicate), respectively.

These melting points are three eutectic points of the glass system $K_2O$—$SiO_2$ which correspond to the following compositions:

at 780° C.—the mixture is of $K_2O$—$SiO_2$ and $K_2O$—$2SiO_2$;

at 742° C.—the mixture is of $K_2O$—$2SiO_2$ and $K_2O$—$4SiO_2$; and at 767° C.—the composition is $K_2O$—4SiO2.

All potassium salts can be dissolved in water without changing their chemical composition. The concentration of potassium silicate salts in solution is preferably about 0.5–1 gram per liter for this invention.

The alkali-boron coating is comprised of the glass system $K_2O$—$B_2O_3$. This system has several eutectic points below the metallic temperature of the furnace tubes or coils. In the temperature range of about 780°–950° C., the system $K_2O$—$B_2O_3$ comprises about 40–86 wt. % of $B_2O_3$. When more salt of the alkali metal is added to the system $K_2O$—$B_2O_3$, the melting point of this system is barely increased. A wider range of glass forming action occurs with system $Li_2O$—$B_2O_3$. The eutectic point of lithium borate ($LiBO_2$) is about 832° C.

The barium-boron coating is comprised of the glass-system BaO—$B_2O_3$. This system forms glass with relatively low melting points. The melting points are about 878–899° C. with the content of $B_2O_3$ ranging from about 35 to 73 wt. %. Boric oxide ($B_2O_3$) can be evaporated from the melt and the coating from BaO—$B_2O_3$ is settled. When the melt is consolidated it comprises about 18 wt. %. of $B_2O_3$.

The nitrate-glass coating is formed from a mixture of the Groups IA and IIA metal salts of nitric acid. The glass forms when the system consists of a mixture of alkali and alkaline earth metal salts. The melting points of this glass range from about 350 to about 545° C. The boundaries or borders of forming the nitrate glass are as follows:

| SYSTEM | |
|---|---|
| $Mg(NO_3)_2 - LiNO_3$ | 36–52 mol. % of $LiNO_3$ |
| $Mg(NO_3)_2$ —$CsNO_3$ | 47–75 mol. % of $CsNO_3$ |
| $Mg(NO_3)_2$ —$KNO_3$ | 24–61 mol. % of $KNO_3$ |
| $Mg(NO_3)_2$ —$RbNO_3$ | 40–67 mol. % of $RbNO_3$ |
| $Ca(NO_3)_2$ —$LiNO_3$ | Does not form glass |
| $Ca(NO_3)_2$ —$KNO_3$ | 40–70 mol. % of $KNO_3$ |
| $Ca(NO_3)_2$ —$RbNO_3$ | 32–75 mol. % of $RbNO_3$ |
| $Ca(NO_3)_2$ —$CsNO_3$ | 64–75 mol. % of $CsNO_3$ |

The alkali-phosphorus coating is preferably made from potassium hexametaphosphate $(KPO_3)_6$ which has a melting point of about 820° C. The system $K_2O$—$P_2O_5$ may also be used and is stronger than the systems $K_2O$—$SiO_2$ and $K_2O$—$B_2O_3$ (which may also be used) because the binding between P—O is more stable than between Si—O and B—O.

With reasonably optimum temperatures, the coils may be coated with the coke suppression films in about 2–3 hours.

After applying the suppression coating or film on the inner walls of the coil, the same procedure discussed above for decoking and adding a coke suppression coating or film of this invention may be used for the other coils.

Unlike pyrolysis technology known in the prior art, the procedure of applying the coke suppression films of this invention can be carried out without shutting down the cracking furnace. Decoking of other coils may even be started while suppression additives are being added to the hydrocarbon stream in coils just decoked according to the invention.

Figure 1B:
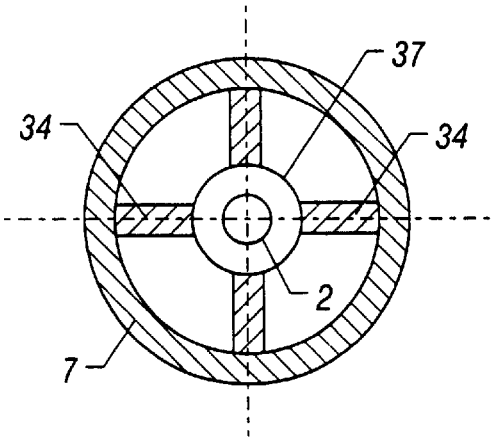
FIG. 1*b* is a transverse cross-sectional view taken along line 1*b*—1*b* of FIG. 1*a;*

Referring now to the apparatus of the invention, as shown in FIGS. 1*a* and 1*b,* in brief, the apparatus comprises a first, liquid solution conveying tube 1 terminated by a centrifugal atomizing nozzle 2 and concentrically mounted within a second, insulating tube 3 carrying, at a forward end, a conical gaseous flow deflector 4, operatively aligned with the nozzle 2, and a rearwardly spaced disc-form baffle 5. The subassembly is inserted through access port 6 concentrically into a coil or tube 7 at a location of a cracking furnace where the temperature is preferably between about 300 and 650 degrees centigrade with the base 8 of the flow deflector 4 extending substantially entirely across the cracking tube diameter and the baffle 5 preventing substantial hot gas flow to the access port, so that a process gas 9 from a convection section 10 flows through the annular space between tubes 3 and 7 into the flow deflector 4, dispersing and completely vaporizing the atomized drops of liquid solution entirely within a zone within the deflector volume, thereby preventing contact of the drops with either the deflector or the cracking tube wall so that only small solid particles of active material are entrained dispersed in the process gas and proceed along coil 11 downstream into the radiation zone tube of the cracking furnace.

Figure 2A:
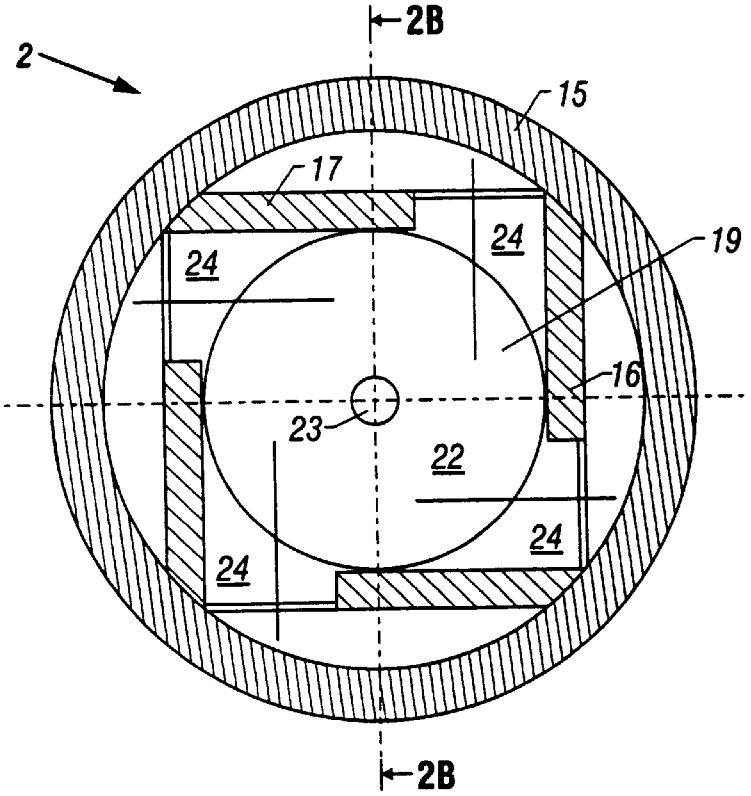
FIG. 2*a* is a transverse cross-sectional view of the centrifugal nozzle of the apparatus taken along line 2*a*—2*a* of FIG. 2*b;*
Figure 2B:
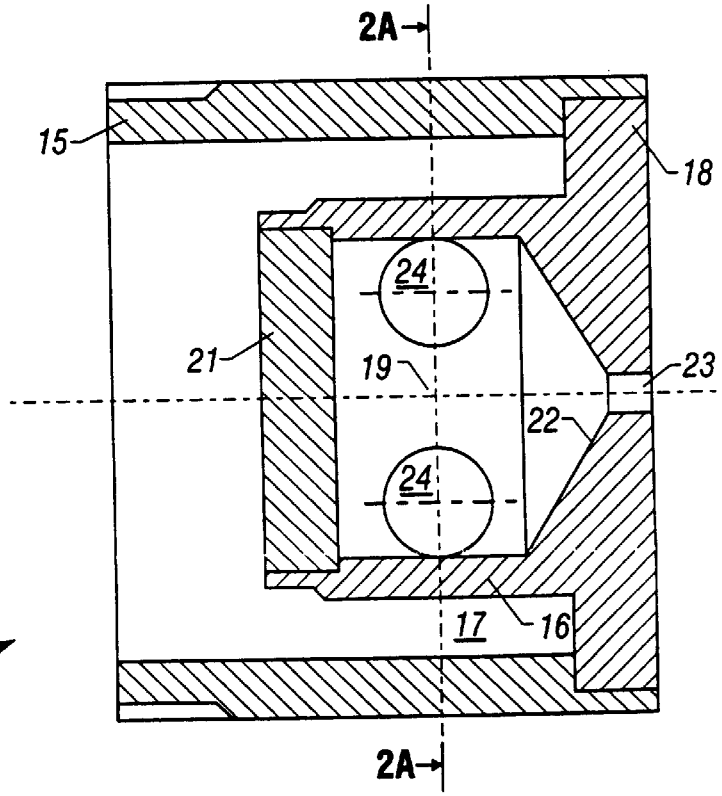
FIG. 2*b* is an axial cross-sectional view of the nozzle taken along line 2*b*—2*b* of FIG. 2*a;*

As shown in greater detail in FIG. 2*a* and FIG. 2*b,* the metal nozzle 2 comprises a hollow cylindrical outer casing 15 containing an inner spin chamber block 16 having a square section outer wall 17 extending rearwardly from a disk-shaped mounting flange 18 welded to the casing. The chamber block 16 is bored out to provide a central, axially extending, generally cylindrical spin chamber 19 with a frusto conical section 22 conveying a vortical stream of liquid from the spin chamber to one or more axial outlet orifice(s) 23, and four, equi-spaced, tangential inlet channels 24 to the spin chamber.

A rear end of the wall receives a cap 21 welded thereon, closing the chamber rear. As the respective corners of the outer wall 17 are closely adjacent the outer casing, the incoming liquid solution is effectively split into four discrete streams for entering respective inlet channels.

The diameter of the nozzle orifice can be selected between about 0.2–2.2 mm. The drop sizes are about 0.2–40 microns, and the angle subtended by the spray is from about 5–30 degrees.

Other centrifugal nozzles of the prior art which may, for example, have spiral flow guides may be substituted. Without limitation, prior art examples that may be used include, nozzles described in the Chemical Engineer's Handbook edited by John Perry and published by McGraw-Hill Book company in various editions (e.g. 1963 et seq.), the disclosure of which is incorporated herein by reference, particularly as illustrated on page 76 of the Russian translation of the edition published in 1949.

In practice, the flow rate or throughput of liquid solution can be up to 300 liters per hour; the flow rate of said gas process stream through said conical flow deflector 4 is about 15–30 kg/meter square per second.

The mixing of the solution spray and process gas stream can be carried out at any suitable temperature and pressure conditions, preferably at about 300–650 C and about 0.5–6 atmospheres.

The process gas stream may be (water) steam, or a gaseous mixture of hydrocarbons and steam. Preferably, the hydrocarbons are ethane, propane, butane, naphtha, kerosene, gas oil or mixture thereof. Generally, the conical flow deflector is positioned at the location where the process gas stream is entering the reaction/radiant zone of the cracking furnace.

The flow deflector 4 shown in FIGS. 1*a* and 1*b,* comprises a conical portion 31 formed by a stepped wall portion comprising a series of open ended, hollow cylindrical portions 33 of progressively increasing diameters mounted together in axially displaced, coaxial relation by four axially extending, equiangularly displaced, radial fins 34. Rearward, inner end portions of the fins 35 bridge a small gap 36 and attach to a further tubular portion 37 coextensive with the tube 3 and which is formed with a series, (eight in FIG. 1, four in FIG. 3), of lateral, process gas admitting apertures 38 for admitting process gas transversely into a mixing and vaporization/drying zone within the deflector. Thus, the deflected process gas will enter the deflector both axially through the open ends of the cylindrical portions and transversely through the lateral apertures 38, gap 36 and small axial gaps between adjacent cylindrical portions which also form lateral apertures, providing a radially inwardly directed draught surrounding and converging on the spray jet for substantially the entire length of the deflector thereby, confining the spray jet centrally of the tube ensuring that no drops contact the deflector wall.

Figure 3:
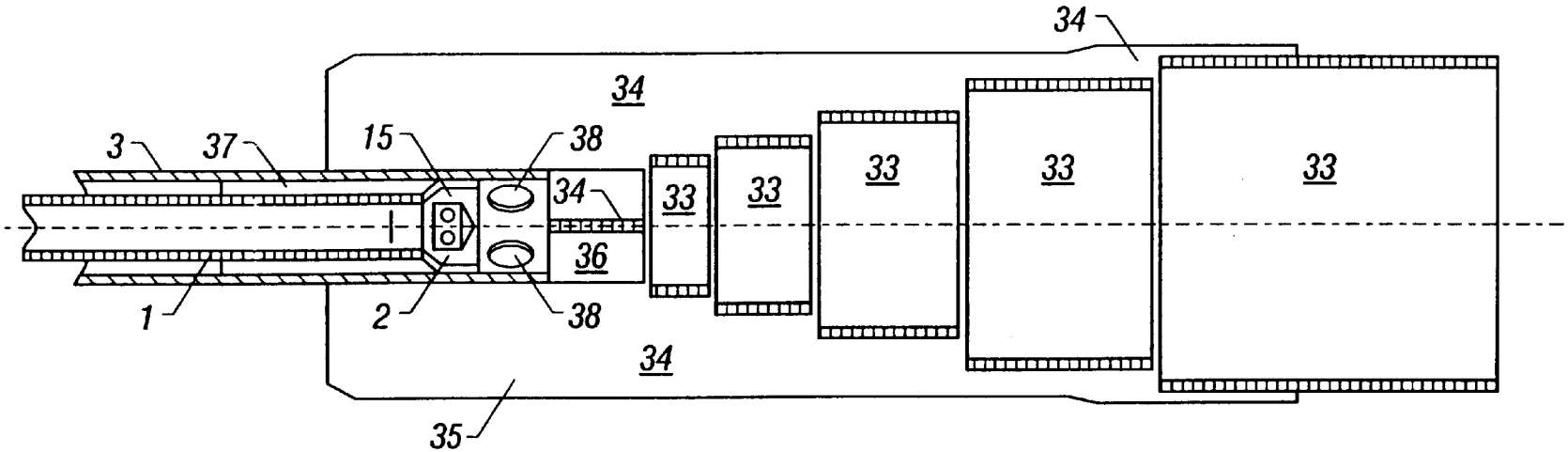
FIG. 3 is a schematic elevational view of a flow deflector similar to that shown in FIG. 1*a* to an increased scale.

As shown in FIG. 3, a portion of tube 3 adjacent the extension 37 receives the nozzle casing 15 concentrically as a close or sliding fit and the rear end portion of the nozzle casing wall is welded to the end of tube 1.

Figure 4A:
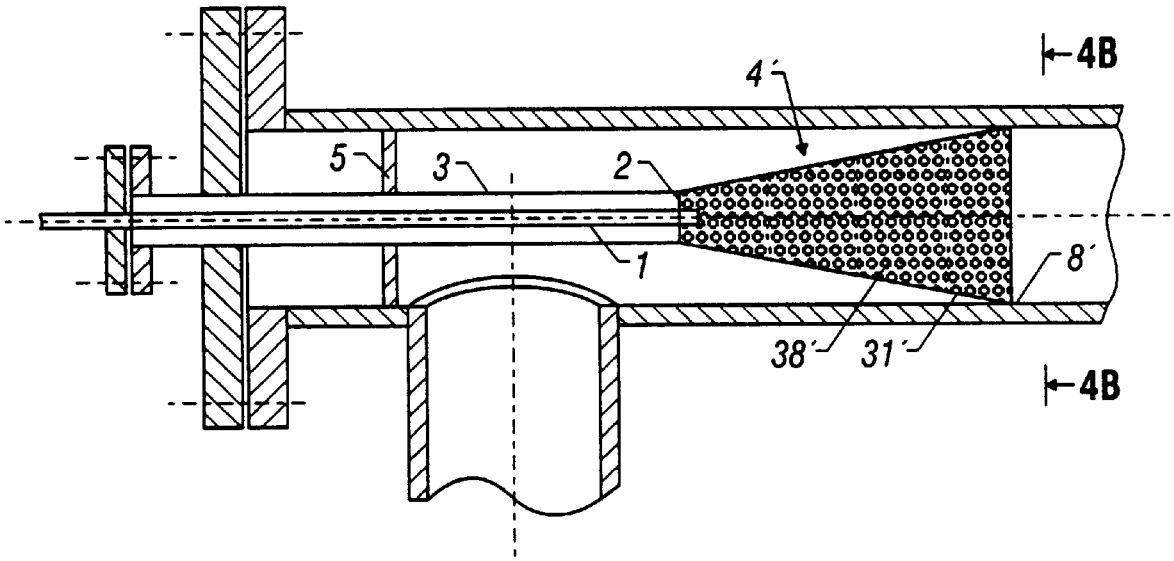
FIG. 4*a* is a diagrammatic view of a second embodiment of an injection apparatus according to this invention incorporating a different flow detector, as tested in an industrial plant.
Figure 4B:
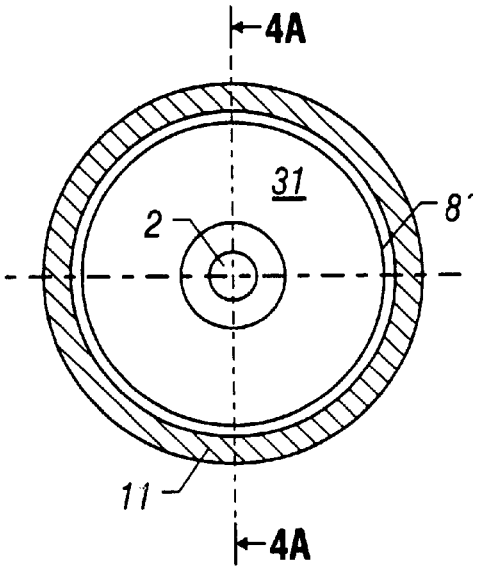
FIG. 4*b* is a transverse cross-sectional view taken along line 4*a*—4*b* of FIG. 4*a;*

FIGS. 4*a* and 4*b,* illustrate an embodiment for injecting a liquid solution into a thermal process cracking stream as tested in an industrial plant. Tube 1 (outer diameter about 25 millimeters) is fastened to nozzle 2. The flow deflector 4' has a continuously divergent conical wall 31' with a smaller end fastened by welding to the second tube 3 and a larger end 8' extending across substantially the entire diameter of the cracking tube. The wall 31' is perforated with lateral process gas admitting apertures 38'. The operating conditions are similar to those described above and, as above, the flow deflector defines a chamber with an internal mixing and vaporization zone which ensures that solution does not contact either the coil walls or the deflector wall.

In general, the process gas stream which passes through the apertures has both axial and transverse components (between 0 and 90 degrees to the axis of the flow deflector). The outer diameter of the open end or base of the deflector can be selected to be between about 2–50 mm less then the inner diameter of the furnace tube, which is usually between about 60 and about 250 mm. The axial length of the conical flow deflector length can be selected to be between about 300–600 mm.

The inner diameter of the second tube 3 can be selected to be about 1.2–3.0 times larger than the outer diameter of said first tube 1 conveying the liquid solution, and the second tube is attached to the casing of the nozzle 2, thereby forming the insulating annular space between said first tube and second tubes 1 and 2, respectively.

A solution injected into a furnace tube will experience the following operations:

atomizing of solution;

mixing drops with a process gas stream; and drying of drops.

In these versions, the solution (e.g. water) can be applied to the nozzles at an absolute pressure of about 10–20 (and higher) atmospheres providing a pressure drop across the nozzle of 7–17 (and higher). This can atomize the solution to drops with diameters of about 0.2–3.0 microns. As a result of the large total surface area of the drops, the practical time is very small (less than 0.0004 seconds). This time determines the length of the conical flow deflector as the drops should evaporate completely before exit. Liquid solution properties, such as density, viscosity etc. are given in the Chemical Engineer's Handbook by John Perry, referred to above.

In the conical flow deflector, the mixing of drops with the process gas stream is carried out at temperatures of about 300–650° C. The conical deflector prevents contact between the drops and the hot tube surfaces, thereby preventing any damage to the furnace tubes. The conical flow deflector should be arranged so that substantially all process gas passes therethrough enabling the length to be minimized.

Evaporation of the liquid solution leaves solid additive particles in the form of hollow balls of the same size as the liquid drops.

Calculation of the approximate heat transfer between the liquid drops and the process gas stream can be carried out by the method using the volume heat transfer coefficient Kv given by the following formula:

$$Kv=140G^{0.16}/d \text{ (watt/m hr. C)},$$

wherein G is the mass velocity of the process gas stream, kg./m second; and d is the furnace tube inside diameter (ID), m.;

In this case, the total heat which is transferred to a solution equals:

$$Q-Kv*V*_{\Delta}\text{tav., (watts)},$$

wherein V is the volume of the conical flow deflector; and $_{\Delta}$tav. is the average of the difference between temperatures at inlet and outlet of the flow deflector.

The Qt can be calculated from the following equation:

$$Qt=Gs.Cp(T_2-T_1)+Gs.r+Gs.Cp(T_3-T_2), \text{ (watts)},$$

wherein Gs is the flow rate of a solution, liters/hr;

Cp is the specific heat, watts/kg C;

$T_1$ is the initial temperature of a liquid solution, C;

$T_2$ is the water boiling temperature, C;

$T_3$ is the final temperature of the mixture of a liquid solution and the process gas stream at the outlet of the flow deflector; and r is the evaporation heat, watts/kg.

Thus, evaporating and superheating 300 liters/hr of solution requires a conical flow deflector with a volume about 0.113 liters.

To calculate the nozzle characteristics, the following empirical formulas can be used:

The angle of the liquid spray at nozzle outlet:

$$Tga/2=w/Uo, \quad a)$$

wherein w is the circuit velocity of a liquid solution into the spin chamber of the nozzle, m/sec.; and Uo is the linear velocity of liquid solution at outlet the nozzle, m/sec.

Maximum size of drops (the median diameter):

$$Smax=K.8.\delta g/pU_2o, \text{ (micrometers)}, \quad b)$$

wherein δ is surface tension, kg/meter; for water δ=0.00745 kg/m c;

g is 9.81 meter/sec s;

p is liquid solution density, kg/m c; and

K is a coefficient, depending on the liquid solution quality; for water K=2.5

As a rule, the flow rate of the solution is about 100–600 liters/hr. If this rate increases, the length of the solution spray can be so long as to cause problems with tube breakage.

By using formulas (a) and (b) described above, any nozzle data can be derived. However, because the formulas are empirical, it is preferable to test the actual performance of any selected design before use.

Figure 7:
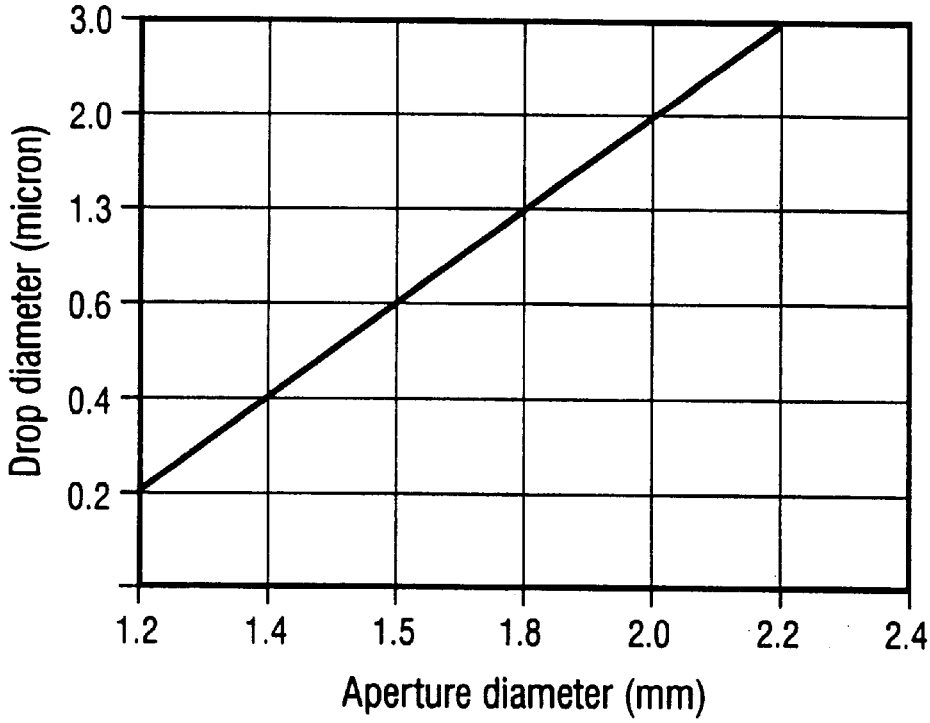
FIG. 7 is a graph illustrating the dependence of drop diameter on nozzle outlet aperture diameter.

FIG. 7 illustrates dependence of drop diameter on nozzle orifice diameter. The input channel diameter d of the nozzle is 4.0 mm and the number of channels is 4.

Figure 8:
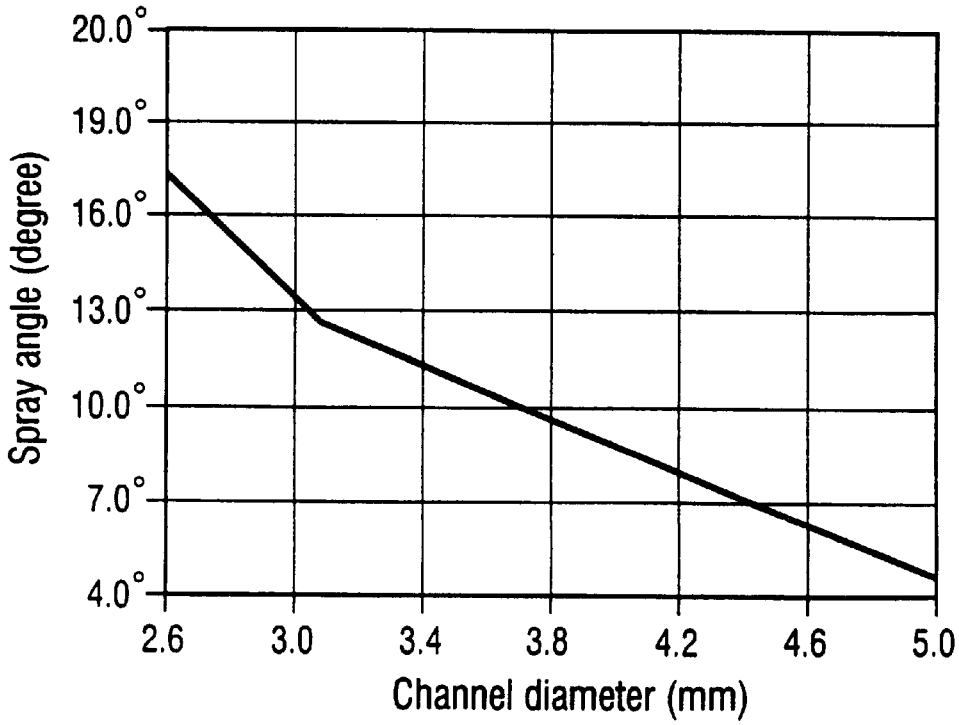
FIG. 8 is a graph illustrating the dependence of the angle subtended by the spray on nozzle input channel diameter.

FIG. 8 illustrates the dependence of the spray angle on input channel diameter (4 channels). The diameter of the nozzle orifice is about 2 mm.

As demonstrated by FIGS. 7 and 8, increasing outlet hole diameter will increase drop size and increasing input channel diameter will decrease spray angle. By considering both formulas, the optimum data can be selected.

Figure 5A:
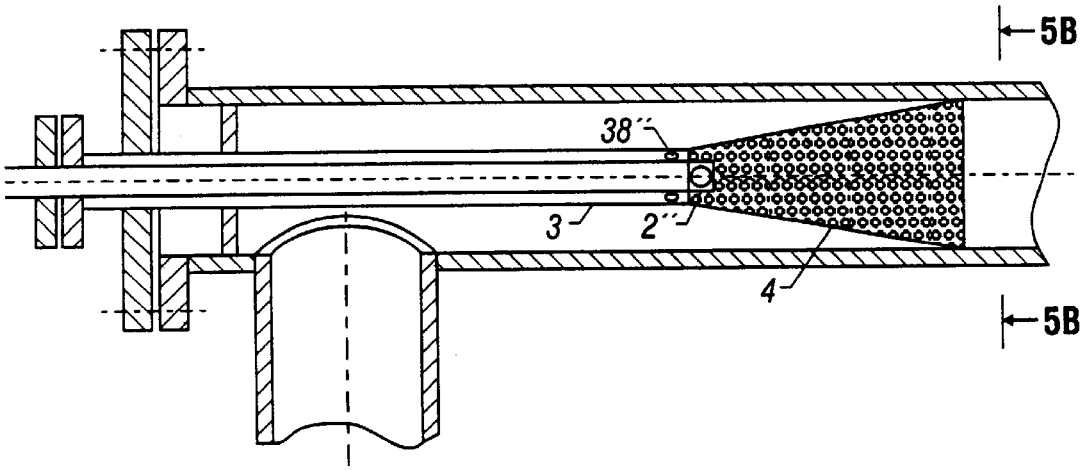
FIG. 5*a* is a diagrammatic view of another embodiment of an injection apparatus according to this invention incorporating a flow detector similar to that of FIG. 4*a* with some modifications and a multi-nozzle arrangement.
Figure 5B:
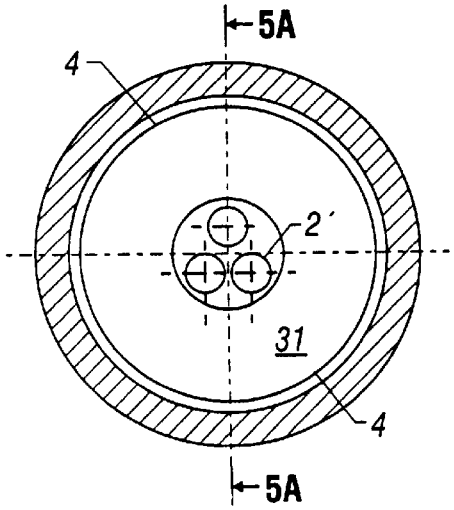
FIG. 5*b* is a transverse cross-sectional view taken along line 5*b*—5*b* of FIG. 5*a* showing a multi-nozzle, viewed in an upstream direction.

The embodiment shown in FIGS. 5*a* and 5*b* is closely similar to that of FIGS. 4*a* and 4*b*, except that a multi nozzle arrangement of three nozzles 2" is provided and a plurality of lateral process gas admitting apertures 38" are also provided in the tube 3, upstream of the nozzle 2". This enables a larger throughput with smaller nozzle orifice size, reducing drop-size and vaporizing time, therefore enabling a reduction in the length of the deflector.

Figure 6A:
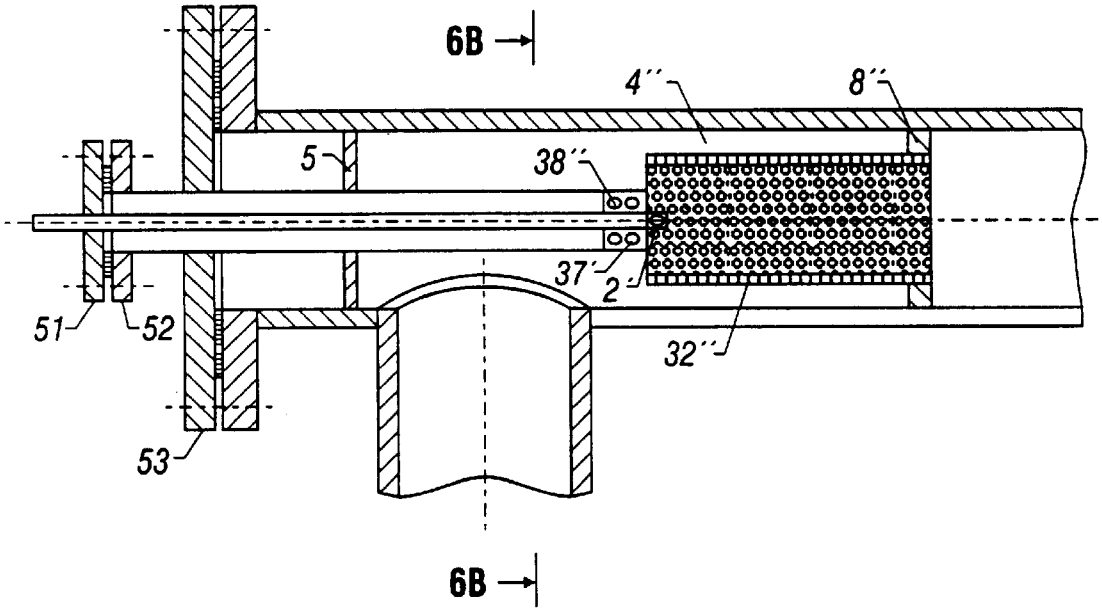
FIG. 6*a* is a diagrammatic view of a further embodiment of an injection apparatus according to this invention incorporating another flow detector.
Figure 6B:
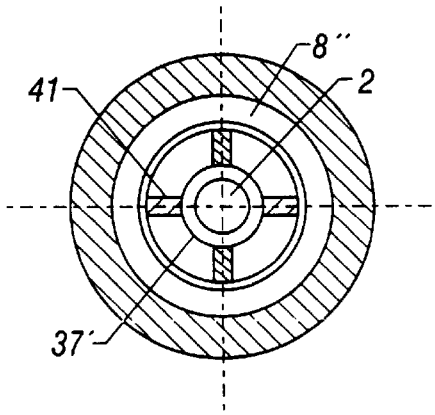
FIG. 6*b* is a transverse cross-sectional view taken along line 6*b*—6*b* of FIG. 6*a* looking in a downstream direction.

In the embodiment shown in FIGS. 6*a* and 6*b*, the deflector 4" has a perforated, open-ended cylindrical wall portion 32" of larger diameter than the nozzle and which terminates at a downstream end in an imperforate, radially extending flange 8" which bridges between the wall portion and the internal surface of the tube, assuring that substantially all process gas flows through the deflector. The wall portion 32" is secured at an upstream end to a perforated tubular wall portion 37' by four equiangularly located, radially extending axial fins. As in previously described embodiments, the perforations provide lateral apertures 38" so that the process gas enters the mixing and vaporizing zone within the deflector through the apertures 38" at ninety and through open ends at zero degrees relative to the axis.

The axial position of the liquid conveying tube 1 and nozzle relative to tube 3 and deflector 4 can be adjusted. Tube 1 is welded to handle 51 and tube 3 is welded to handle 52 and flange 53. Release of bolts securing handles 51 and 52 permits axial adjustment of tube 1 and nozzle 2, while release of bolts securing flange 53 to the tube port enables axial adjustment of tube 3 and deflector 4.

Preliminary industrial plant test data, (not described herein in detail), indicate that use of the apparatus (FIGS. 1*a*, 1*b*, 2*a*, 2*b*, 3, 4*a*, 4*b*, 5*a*, 5*b*, 6*a* and 6*b*) for injecting decoking additive and coke suppression additive solutions of this invention into a thermal naphtha stream cracking furnace result in removing coke deposits, and reducing new coke formation, and consequently increasing operation time between shutdowns. It is, therefore, concluded that this apparatus is suitable for catalytic pyrolysis during thermal cracking of any hydrocarbons. Actually, for this test data, the particle sizes, formed by evaporation of spray in the flow deflector were about 0.2–40.0 microns, and the catalytic surface was formed in the conical flow deflector, at a rate of about 166,734.0 meters/second. This increased yields of the desirable lower olefins by about 2–10 wt. %. The numbers of particles can be increased significantly by reducing the diameter of the nozzle orifice or by increasing the input pressure of the liquid solution to the nozzle.

The method of the present invention can be better understood by the following examples which illustrate the use of the decoking additives and steam for removing coke deposits and the use of the coke suppression additives into the steam and hydrocarbon stream to form a coating or film for suppressing coke deposits.

placed back into normal operation with the same operating conditions as described above in order to demonstrate the comparative advantages of the present invention.

After a run of 40 days, the metal temperature of the tubes increased from 915° C. to about 950° C. and the hydrocarbon feed pressure at the inlet of the coil was increased from about 4.5 kg/cm$^2$ to about 5.2 kg/cm$^2$. About 300 liters per hour of an aqueous solution containing decoking additives of this invention were introduced into the radiant coils.

In this example, the additive solution included potassium carbonate ($K_2CO_3$) and magnesium acetate. The composition of the additive mixture was 95 weight percent potassium carbonate and 5 weight percent magnesium acetate. The additive concentration in the solution was 700 mg per liter. The steam flow was increased from 1000 kg/hr to 1500 kg/hr for each coil. The hydrocarbon feed was eliminated after the first hour. The temperature of the decoking process was maintained from about 835° C. to about 850° C. Upon completion of the decoking process the furnace was then returned to the onstream pyrolysis operation. The data which was collected during the decoking with an additive solution of this invention is shown in Table 3.

TABLE 3

| Time, | Hydrocarbon feed, T/hr | | Steam Flow, T/hr | | Additives Solution, L/hr | | TEMPERATURE, ° C. At outlet | | At the skimmer | | At the saddle | | At the transition | | Pressure kg/ss | |
|---|---|---|---|---|---|---|---|---|---|---|---|---|---|---|---|---|
| Hour | left | right | left | right | left | right | left | right | left | right | left | right | left | right | left | right |
| 1 | 4.0 | 4.0 | 1.0 | 1.0 | 300 | 300 | 835 | 835 | 835 | 825 | 990 | 975 | 540 | 540 | 6.0 | 5.8 |
| 2 | — | — | 1.5 | 1.5 | 300 | 300 | 859 | 850 | 780 | 770 | 850 | 850 | 605 | 605 | 4.4 | 4.2 |
| 3 | — | — | 1.5 | 1.5 | 300 | 300 | 850 | 850 | 830 | 790 | 840 | 840 | 720 | 720 | 3.1 | 2.8 |
| 4 | — | — | 1.5 | 1.5 | 300 | 300 | 850 | 850 | 825 | 805 | 800 | 810 | 710 | 710 | 1.8 | 1.8 |
| 5 | 4.0 | 4.0 | 1.0 | 1.0 | 300 | 300 | 835 | 835 | 827 | 815 | 960 | 957 | 540 | 540 | 4.5 | 4.5 |
| 6 | 4.0 | 4.0 | 1.0 | 1.0 | — | — | 835 | 835 | 830 | 818 | 950 | 960 | 540 | 540 | 4.5 | 4.5 |

EXAMPLE 1

(Comparative)

A propane-butane fraction was introduced into a pyrolysis furnace at a rate of 8 tons per hour (8 T/hr) as a feedstock. Such a feedstock is known to produce a large amount of coke during pyrolysis. The propane-butane fraction has the following composition in percentage by weight: ethane, 0.4; propane, 19.5; propylene, 2.1; isobutane, 12.0; N-butane, 10.6; butadiene, 4.1; $C_5$ and higher, 51.28; sulphur, 0.02. Steam was also introduced into the furnace at a flow rate of 1.0 ton per hour.

The pyrolysis furnace used in this example has two parallel coils (passes), and the temperature of the thermal cracking gas at the furnace outlet was 835° C.

After a run of 1,224 hours, furnace operation was discontinued. It was evident that upon the termination of the run, there was substantial accumulation of coke in the coils. The evidence included an increase in the metal tube temperature from 915° C. to about 985° C. and an increase in the pressure at the inlet of the coils from about 4.5 kg/cm$^2$ to about 6.5 kg/cm$^2$.

The coils of the furnace were decoked with a mixture of steam and air, in the manner common in the prior art. The decoking process took two days to complete at which time the decoking was discontinued and the parts of the furnace coil which have the greatest propensity to accumulate coke were opened for inspection.

Inspection revealed that the coils were damaged which required the replacement of 42 meters of the tubes. The furnace was repaired at 21 days and then the furnace was In the above example, which used a decoking additive of the invention during the decoking process, the temperature of the metal of the tubes remained from 900° C. to 905° C. which is below the temperature limitation for this tube metal. Thus, this example demonstrates that practicing this invention avoids overheating the tubes of the coil which thereby prolongs the life of the coil and minimizes damage.

In the above example which used a decoking additive of the invention, a large amount of the coke deposit was removed due to spalling of the coke within the coils. As a result of the spalling, granular masses of coke moved in the coil along with the stream of steam. The spalling effect was so great that the granular masses of coke could be heard moving through the coils. After two hours of the decoking process all bright spots of the tubes disappeared. The completion of the decoking process was indicated by an analysis of the carbon oxide content of the steam flow.

As shown in Table 3, when the hydrocarbon feed was stopped, the temperature regime of the furnace was changed only in the convection section. The temperature of the coils in the radiation section where the pyrolysis took place remained the same for the coils which were on-stream undergoing pyrolysis and the coils which were off-stream undergoing decoking. Consequently, the furnace could be operated in normal operation with periodic decoking for a long period of time without exceeding the temperature limitations of the metal which was to used to make the coil.

The above described plant run of the pyrolysis furnace in accordance with the present invention took place over a period of 180 days. Upon conclusion of the run, the unit was shut down for inspection of the coils. The tubes, upon completion of the 180 day run, showed no evidence of coke deposits nor corrosion.

EXAMPLE 2

This process of decoking is analogous to example 1 except that the hydrocarbon feedstock was eliminated from the left coil while steam and decoking additives of the invention were passed through the coil to effect the decoking and, simultaneously, the right coil was maintained on-stream to continue pyrolysis. Table 4 represents the data collected for the decoking process of the left coil.

After several decokings of both coils, according to the method of the invention, the furnace was run 180 days before being shut down. Inspection of the furnace revealed no coke deposition after 180 days.

Table 6 shows 11 decoking additive combinations which can be used in accordance with the method of this invention. The 11 additives shown in Table 6 are effective to remove coke deposits from coils in about two hours when the additive is used as described in the process in Example 1.

TABLE 4

| Time, | Hydrocarbon feed, T/hr | | Steam Flow, T/hr | | Additives Solution, L/hr | | TEMPERATURE, ° C. At outlet of coil* | | At the skimmer*** | | At the roof of the furnace | | At the transition** | | Pressure at inlet kg/ss | |
|---|---|---|---|---|---|---|---|---|---|---|---|---|---|---|---|---|
| Hour | left | right | left | right | left | right | left | right | left | right | left | right | left | right | left | right |
| 1 | 4.0 | 4.0 | 1.0 | 1.0 | 300 | — | 835 | 835 | 835 | 830 | 930 | 905 | 540 | 540 | 6.0 | 5.7 |
| 2 | 4.0 | 1.5 | 1.0 | 300 | — | 835 | 835 | 825 | 850 | 850 | 850 | 605 | 605 | 4.4 | 5.7 | |
| 3 | — | 4.0 | 1.5 | 1.0 | 300 | — | 835 | 835 | 805 | 810 | 810 | 840 | 720 | 720 | 2.9 | 5.7 |
| 4 | — | 4.0 | 1.5 | 100 | 300 | — | 835 | 835 | 815 | 810 | 800 | 840 | 700 | 700 | 1.8 | 5.7 |
| 5 | 4.0 | 4.0 | 1.0 | 1.0 | — | — | 835 | 835 | 820 | 810 | 850 | 850 | 610 | 610 | 4.5 | 5.7 |
| 6 | 4.0 | 4.0 | 1.0 | 1.0 | — | — | 835 | 835 | 820 | 810 | 860 | 862 | 535 | 540 | 4.5 | 5.7 |
| 7 | 4.0 | 4.0 | 1.0 | 1.0 | — | — | 835 | 835 | 820 | 810 | 860 | 862 | 535 | 540 | 4.5 | 5.7 |

*Coil outlet temperature
**Temperature at point of transition from convection tubes to cracker tubes
***Temperature at point of transition the combustion gases from the radiant zone to the convection zone Upon completion of the decoking of the left coil of the furnace, the same procedure was used to decoke the right coil. Table 5 represents the data for the decoking process of the right coil.

TABLE 5

| Time, | Hydrocarbon feed, T/hr | | Steam Flow, T/hr | | Additives Solution, L/hr | | TEMPERATURE, ° C. At outlet of coil* | | At the skimmer*** | | At the roof of the furnace | | At the transition** | | Pressure at inlet kg/ss | |
|---|---|---|---|---|---|---|---|---|---|---|---|---|---|---|---|---|
| Hour | left | right | left | right | left | right | left | right | left | right | left | right | left | right | left | right |
| 1 | 4.0 | 4.0 | 1.0 | 1.0 | — | 300 | 835 | 835 | 820 | 810 | 860 | 862 | 535 | 540 | 4.5 | 5.7 |
| 2 | 4.0 | — | 1.0 | 1.5 | — | 300 | 835 | 835 | 795 | 745 | 900 | 810 | 525 | 525 | 4.5 | 2.7 |
| 3 | 4.0 | — | 1.0 | 1.5 | — | 300 | 835 | 835 | 785 | 735 | 900 | 810 | 490 | 490 | 4.5 | 2.0 |
| 4 | 4.0 | — | 1.0 | 1.5 | — | 300 | 835 | 835 | 780 | 735 | 900 | 810 | 495 | 495 | 4.5 | 1.8 |
| 5 | 4.0 | 4.0 | 1.0 | 1.0 | — | — | 835 | 835 | 825 | 800 | 850 | 815 | 540 | 540 | 4.5 | 4.5 |
| 6 | 4.0 | 4.0 | 1.0 | 1.0 | — | — | 835 | 835 | 815 | 810 | 870 | 815 | 535 | 535 | 4.5 | 4.5 |
| 7 | 4.0 | 4.0 | 1.0 | 1.0 | — | — | 835 | 835 | 815 | 810 | 840 | 836 | 535 | 535 | 4.5 | 4.5 |

*Coil outlet temperature
**Temperature at point of transition from convection tubes to cracker tubes
***Temperature at point of transition the combustion gases from the radiant zone to the convection zone

TABLE 6

| No. of | CONCENTRATION, mg/L | | | | | | |
|---|---|---|---|---|---|---|---|
| solution | $LI_2CO_3$ | $K_2CO$ | $LiNO_3$ | $KNO_3$ | K(AC) | $Mg(AC)_2.4H_2O$ | $CA(AC)_2.H_2O$ |
| 1 | 500 | — | — | — | — | 25 | — |
| 2 | — | 650 | — | — | — | 32.5 | — |
| 3 | — | — | — | — | 650 | 32.5 | — |
| 4 | — | — | 500 | — | — | 25 | — |
| 5 | — | — | — | 600 | — | 30 | — |
| 6 | — | — | — | — | — | 650 | 50 |
| 7 | — | — | — | — | 650 | — | 35 |
| 8 | — | 200 | — | — | 100 | 150 | 250 |
| 9 | 300 | 100 | — | — | — | 100 | 100 |
| 10 | — | 500 | — | — | — | 90 | — |
| 11 | 100 | — | — | — | — | 400 | 200 |

Tables 3, 4, and 5 make reference to temperature measurements taken at the transition, at the skimmer and at the saddle. These locations are shown by the circles in FIG. 9 identified respectively by reference numerals 32, 33, and 34.

The above examples show:

(a) Removal of coke was found to be related to the time length of decokings (Tables 3, 4, and 5);

(b) Complete removal of coke was possible in two hours;

(c) The run length of the cracking furnace can be more than 180 days; and (d) A cracking furnace may be run with one coil or pass having steam and a decoking additive solution of this invention as the only feed to effect decoking in that coil. Decoking one of the coils had no deleterious effect upon the other coils used to conduct pyrolysis simultaneously with the coil being decoked.

EXAMPLE 3

Figure 10:
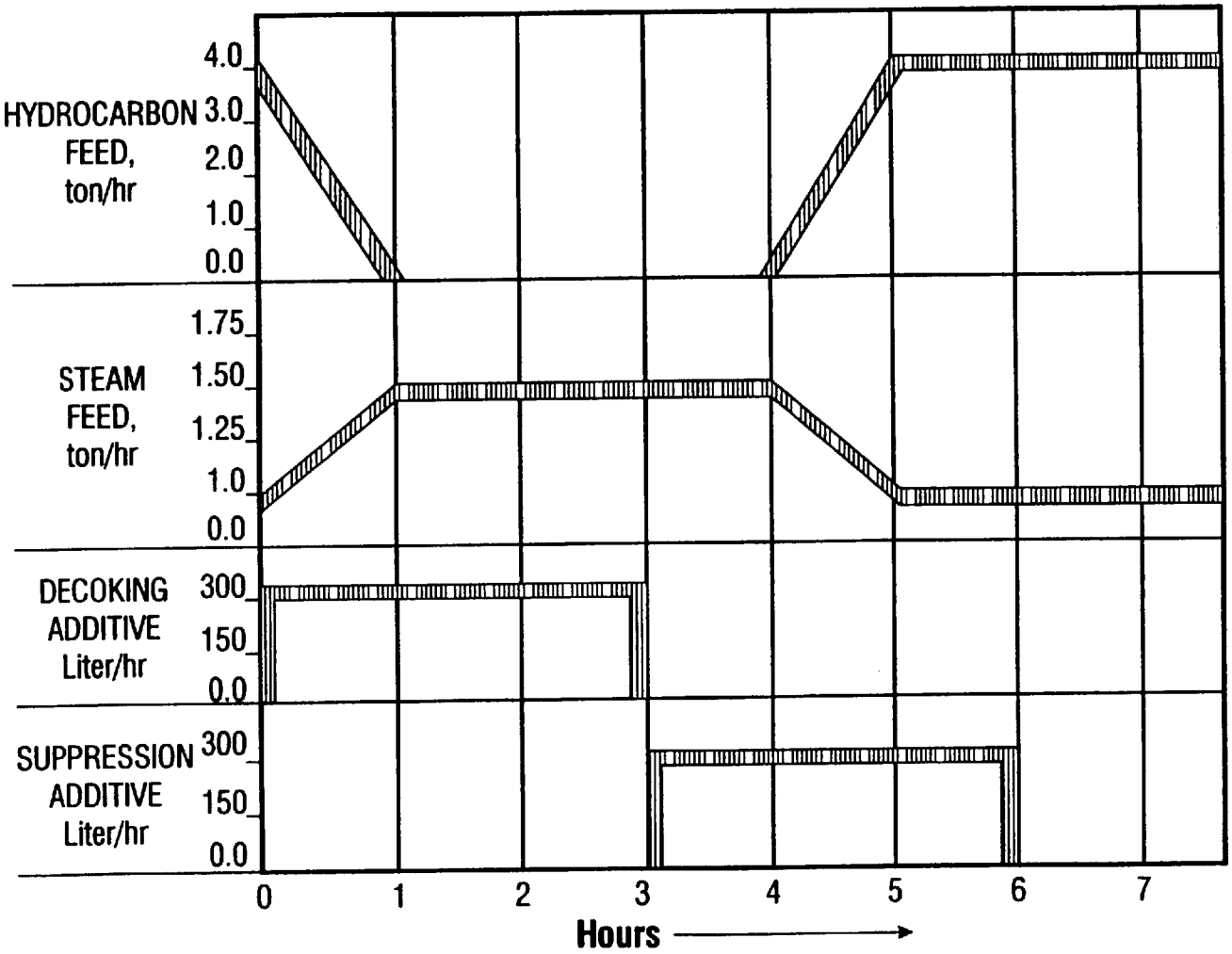
FIG. 10 is a flow diagram showing timing of removing coke deposits and applying suppression films in one example according to the method of this invention.

The pyrolysis furnace run exemplified in Example 2 was run with decoking and suppression additives of this invention dispersed in the steam flows through the off-stream coil. The decoking additive included potassium carbonate ($K_2CO_3$) and magnesium acetate ($MgAC_2$). The composition of this additive mixture was 87 wt. % ($K_2CO_3$) and 13 wt. % $MgAC_2$. The additive concentration in the solution was about 543 mg. per liter. The steam flow was increased from 1,000 kg/hr to 1,500 kg/hr for each coil. The hydrocarbon feed was reduced and eliminated during one hour. The flow diagram of FIG. 10 shows both procedures: removing coke deposits and applying the suppression films.

As can be seen from the flow diagram, the decoking additive solution was introduced into the coil during the first hour, when reduction of the hydrocarbon feed was started. The amount of the decoking additive solution increased to about 300 liters per hour for about 5–10 minutes. The duration of the decoking procedure was about two hours.

After decoking in the steam flows through the off-stream coil, the suppression additive solution was introduced. This additive included the liquid glass, contained about 74 wt. % $SiO_2$ and 26 wt. % $K_2O$, that corresponds to potassium tetrasilicate $K_2O.4SiO_2$ (which has a melting point of about 767° C.). The additive concentration in the solution was about 1000 mg/l, and the amount of the additive solution, about 300 l/hr. was introduced in the steam flow, and then continuously into the hydrocarbon flows through the on-stream coil.

Both of these procedures described above in this Example 3 were repeated four times to decoke and coat the remaining coils. The furnace was run 360 days before being shut down for examination.

EXAMPLE 4

The process of Example 3 was repeated with the exception that the suppression additive included potassium pentaborate, at a concentration of about 700 mg/l. The cracking furnace was run about 360 days without being shut down.

These examples show that one skilled in the art, without departing from the spirit and scope of the invention, can make various changes and modifications of the invention to adapt it to various usages and conditions.

EXAMPLE 5

The process of Example 1 was repeated except that 94 wt. % of potassium acetate, and 6 wt. % of barium acetate were employed to give an elemental weight ratio of Group IA metal to Group IIA metal in the mixture of about 0.1 Results were similar to those obtained in Example 1 using a different decoking additive of this invention.

EXAMPLE 6

The processes of Example 1 and Example 5 were re-run with the decoking additive containing 39 wt. % magnesium acetate and 61 wt. % potassium carbonate to yield a mixture having an elemental weight ratio of the Group IA metal to the Group IIA metal of 5.0. Again, results were similar to results of Example 1 and Example 5 with different decoking additives of this invention.

EXAMPLE 7

The process of Example 3 was re-run with the exception that the suppression additive contained potassium hexametaphosphate $(KPO_3)_6$, the concentration of which was about 950 mg/l. The cracking furnace was run about 360 days without being shut down.

From these examples, one may conclude similar results could be obtained by using the suppression additive containing 7.5 wt. % barium nitrate and 92.5 wt. % boric acid; 100 wt. % potassium pentaborate ($K_2B_{10}O_{16}.8H_2O$) and other compounds represented in Table 2 above.

It was also observed from the examples above that practicing this invention had no deleterious effect upon other equipment downstream of the cracking furnace during any of the above described tests.

While the present invention has been described in terms of certain preferred embodiments, one skilled in the art will readily appreciate that various modifications, changes, omissions, and substitutions may be made without departing from the spirit thereof. The invention is further defined by the following claims.

What is claimed is:

1. A method for injecting a liquid solution into a hot gaseous process stream in a thermal cracking furnace tube, comprising the steps of:

providing a first tube, a second tube which concentrically surrounds said first tube thereby providing a first insulating annular space between the first and second tubes, and a third tube which concentrically surrounds said second tube thus providing an annular channel, and a centrifugal atomizing nozzle with an inlet and an outlet, a tubular gaseous process stream deflecting, mixing and vaporizing device having an inlet and an outlet at respective axial ends and process gas admitting apertures between the ends;

wherein the inlet of the deflecting, mixing and vaporizing device is in coaxial registration with the nozzle outlet;

wherein one end of said first tube is connected to a pressure supply of liquid solution and another end of said first tube is mounted coaxially to the inlet of the nozzle so that the nozzle and deflecting, mixing and vaporizing device are concentrically surrounded by the third tube;

wherein the outlet end of the deflecting, mixing and vaporizing device extends across substantially an entire diameter of the annular channel, wherein one end of said third tube is connected to a process gas supply means and the other end of said third tube leads to a metal-walled reactor for thermally cracking a hydrocarbon gas;

passing a pressurized continuous stream of liquid solution through said first tube, and passing a heated hydrocarbon process gas feed stream through said third tube;

adjusting the flow rates of the streams flowing through the first and the third tubes so that the nozzle atomizes the liquid solution during injection, spraying small drops into the inlet end of the deflecting, mixing and vaporizing device, dispersing the drops within the gaseous process stream passed through the apertures thereby vaporizing the drops entirely within the deflecting, mixing and vaporizing device without the liquid solution contacting the deflecting, mixing and vaporizing device and the third tube.

2. The method of claim 1, wherein the gaseous process stream is passed through the third tube into the deflecting, mixing and vaporizing device, at a temperature of about 300–650° C.

3. The method of claim 2 wherein the drops have diameters of between about 0.2 to about 40.0 microns.

4. The method of claim 3 wherein the drops have diameters of about 3.0 microns.

5. The method of claim 1 wherein the spray subtends an angle of about 5 to about 30 degrees at the nozzle outlet.

6. The method of claim 5 wherein the liquid solution is flowed through said nozzle at a rate of up to about 300 liters per hour.

7. The method of claim 1 wherein the liquid solution comprises element salts of Group IA and Group IIA or mixtures thereof dissolved in a polar solvent.

8. The method of claim 7 wherein the solvent is selected from water, alcohols, polyols, and hydrocarbons.

9. The method of claim 1 wherein the deflecting, mixing and vaporizing device is of conical shape with a smaller end adjacent the nozzle.

10. The method of claim 9 wherein the conical shape is formed by a series of hollow cylindrical wall portions of progressively increasing diameters located axially spaced in coaxial relation.

11. The method of claim 9 wherein the conical shape is formed by a substantially continuously divergent wall perforated to provide the apertures.

12. The method of claim 11 wherein the gaseous process stream passes through said apertures obliquely to the axis.

13. The method of claim 1 wherein the liquid solution is supplied at a pressure of about 10 to about 20 atmospheres.

14. The method of claim 1 wherein the ratio of the cumulative size of the apertures to the axial cross-section of the third tube is about 0.8–3.0.

15. The method of claim 1 wherein the gaseous process stream is flowed through said deflecting, mixing and vaporizing device cone at a rate of about 15–30 Kg/m s sec.

16. The method of claim 1 wherein the deflecting mixing and vaporizing device comprises an open ended cylindrical wall portion extending downstream of the nozzle outlet, the cylindrical wall portion being covered by individual perforations providing some of the process gas admitting apertures and defining a cylindrical chamber of larger diameter than the nozzle, whereby process gas enters the chamber through the perforations in radially inward directions and through an open end in an axial direction.

17. The method of claim 16 wherein the cylindrical wall portion is secured at an upstream end to a further apertured tubular wall portion of smaller diameter than the cylindrical chamber and concentric with the first tube tube.

18. A method for injecting a liquid solution into a hot gaseous process stream in a thermal cracking furnace tube for inhibiting the formation of coke, for removing coke deposits and for providing catalytic pyrolysis, so that the liquid solution does not contact the furnace tube, comprising the steps of:

spraying a jet of atomized drops of the liquid solution into a hot gaseous process stream at an axially central location of a furnace tube remote from walls of the furnace tube; and deflecting outer portions of the process gas stream from around the spray jet radially inward providing a draught of deflected hot process gas surrounding and converging on the jet, thereby confining the drops axially central of the furnace tube away from walls of the furnace tube while mixing with and vaporizing the drops so that the drops do not contact walls of the furnace tube.

19. The method of claim 18 including the step of providing a deflecting, mixing and vaporizing chamber having an open ended cylindrical wall portion aligned coaxially in the furnace tube to receive the jet through an open end, the cylindrical wall portion being covered by individual perforations through which outer portions of the process gas stream are deflected radially inwardly to converge on the jet.

20. The method of claim 1 wherein the deflecting mixing and vaporizing device comprises a divergent conical portion downstream of the nozzle outlet having a smaller end adjacent the nozzle outlet with a peripheral wall part covered by individual perforations providing lateral process gas admitting apertures, whereby process gas enters the chamber through the perforations in radially inward directions and through an open end in an axial direction.

* * * * *